US010128100B2

(12) United States Patent
Shinoda et al.

(10) Patent No.: US 10,128,100 B2
(45) Date of Patent: Nov. 13, 2018

(54) DRIVE METHOD AND DRIVE CIRCUIT FOR LIGHT-EMITTING DEVICE USING GAS DISCHARGE, AND ULTRAVIOLET IRRADIATION DEVICE

(71) Applicant: SHIKOH TECH LLC, Awaji-shi, Hyogo (JP)

(72) Inventors: Tsutae Shinoda, Akashi (JP); Hitoshi Hirakawa, Takasago (JP); Kenji Awamoto, Miki (JP); Junichiro Takahashi, Nishinomiya (JP); Takefumi Hidaka, Kobe (JP)

(73) Assignee: SHIKOH TECH LLC, Awaji (JP)

( * ) Notice: Subject to any disclaimer, the term of this patent is extended or adjusted under 35 U.S.C. 154(b) by 0 days.

(21) Appl. No.: 15/571,922

(22) PCT Filed: Nov. 14, 2016

(86) PCT No.: PCT/JP2016/083695
§ 371 (c)(1),
(2) Date: Nov. 6, 2017

(87) PCT Pub. No.: WO2017/094483
PCT Pub. Date: Jun. 8, 2017

(65) Prior Publication Data

US 2018/0144925 A1 May 24, 2018

(30) Foreign Application Priority Data

Nov. 30, 2015 (JP) ..... 2015-233482

(51) Int. Cl.
*H01J 61/64* (2006.01)
*H01J 1/62* (2006.01)
(Continued)

(52) U.S. Cl.
CPC ..... *H01J 65/04* (2013.01); *G21K 5/02* (2013.01); *H01J 65/00* (2013.01); *H05B 41/24* (2013.01)

(58) Field of Classification Search
USPC ..... 315/169.4, 294, 297, 307, 326, 360; 313/491, 493, 581, 582
See application file for complete search history.

(56) References Cited

U.S. PATENT DOCUMENTS 5,444,335 A 8/1995 Matsumoto et al.
6,429,586 B1 * 8/2002 Nishiki ..... H01J 9/02 313/582
(Continued)

FOREIGN PATENT DOCUMENTS

JP H05-82101 A 4/1993
JP 6-251754 A 9/1994
(Continued)

OTHER PUBLICATIONS

Japan Patent Office, International Search Report issued in corresponding Application No. PCT/JP2016/083695 dated Jan. 24, 2017.

*Primary Examiner* — Bernard Souw
(74) *Attorney, Agent, or Firm* — Stites & Harbison, PLLC; Jeffrey A. Haeberlin

(57) ABSTRACT

During a normal operation, alternating drive voltage to be applied between a pair of electrodes provided to face an outer surface of a bottom part of a gas discharge light emitting tube is switched to a voltage value V2 lower than a voltage value V1 at the time of starting lighting. Further, the alternating drive voltage to be applied during the normal discharge operation is intermittently applied in a predetermined cycle and duty ratio to enable adjustment of light emission intensity.

15 Claims, 18 Drawing Sheets

(51) Int. Cl.

| | |
|---|---|
| ***H05B 37/02*** | (2006.01) |
| ***H05B 41/19*** | (2006.01) |
| ***H01J 65/04*** | (2006.01) |
| ***H01J 65/00*** | (2006.01) |
| ***H05B 41/24*** | (2006.01) |
| ***G21K 5/02*** | (2006.01) |

(56) References Cited

U.S. PATENT DOCUMENTS

| | | | | |
|---|---|---|---|---|
| 6,617,800 | B2 * | 9/2003 | Onozawa | G09G 3/296 315/169.3 |
| 8,143,771 | B2 * | 3/2012 | Shin | G02B 5/22 252/587 |
| 8,796,949 | B2 | 8/2014 | Awamoto et al. | |
| 8,836,240 | B2 * | 9/2014 | Kumar | H05B 41/2883 315/200 R |
| 2006/0043869 | A1 | 3/2006 | Yoon | |
| 2009/0058295 | A1 | 3/2009 | Auday et al. | |
| 2013/0140979 | A1 | 6/2013 | Morita et al. | |

FOREIGN PATENT DOCUMENTS

| | | | |
|---|---|---|---|
| JP | 2004-170074 | A | 6/2004 |
| JP | 2010-219073 | A | 9/2010 |
| JP | 2011-040271 | A | 2/2011 |
| JP | 2011-193929 | A | 10/2011 |
| JP | 5074381 | B2 | 11/2012 |

* cited by examiner

Voltage V
0
Time t
$V_0$
Vf
Vso
Vs
NDM
IDP
SP
FP
DP

Voltage V
0
Time t
$+V_0/2$
$-V_0/2$
FP
DP

DRIVE METHOD AND DRIVE CIRCUIT FOR LIGHT-EMITTING DEVICE USING GAS DISCHARGE, AND ULTRAVIOLET IRRADIATION DEVICE

TECHNICAL FIELD

The present invention relates to a drive method and a drive circuit for a light-emitting device using a gas discharge and an ultraviolet irradiation device. In more detail, the present invention relates to a drive method and a drive circuit for optimally driving a discharge device for a flat light source, particularly an ultraviolet light-emitting flat light source device constructed by arraying a plurality of ultraviolet light-emitting gas discharge tubes parallel to one another.

BACKGROUND ART

There have conventionally been well-known a high-pressure mercury lamp and an excimer discharge lamp as a light source device using a gas discharge. Also, a gas discharge device using an ultraviolet light-emitting phosphor has been well-known as an ultraviolet light-emitting source (for example, see Patent Document 1). Further, an external electrode type gas discharge device having a thin tube configuration suitable for a configuration of a flat light source has also been well-known (for example, see Patent Documents 2 and 3).

PRIOR ART

Patent Document

Patent Document 1: Japanese Patent No. 5074381

Patent Document 2: Japanese Unexamined Patent Publication No. 2004-170074

Patent Document 3: Japanese Unexamined Patent Publication No. 2011-040271

SUMMARY OF THE INVENTION

Problem to be Solved by the Invention

The conventional excimer discharge lamp using an ultraviolet phosphor has problems of requiring an expensive quartz glass envelope and requiring a high-voltage rectangular-wave alternating-current power supply for drive. Further, the conventional gas discharge device for ultraviolet light emission using a gas discharge tube has a complicated electrode structure, and has not yet been developed to a practical level from a viewpoint of luminous efficiency and emission intensity.

Therefore, in order to solve the above-mentioned problems, the present invention provides a novel drive method for optimally driving the gas discharge device for a light source, particularly for an ultraviolet light source, invented previously by the present inventors (see Japanese Patent Application No. 2015-099146/PCT-JP2016-052716), a drive circuit therefor, and an ultraviolet irradiation device.

Specifically, the gas discharge device for a light source to be driven according to the present invention is driven by a sine wave alternating (AC) voltage, but the frequency characteristic and voltage characteristic thereof are not always constant, and it seems almost inevitable that there is a characteristic change due to small variation for each discharge tube and over an operating time. Further, the capacitance of the discharge device that becomes a load is greatly different between at an initial lighting (discharge) start-up and after the start of the discharge, and further, emission intensity degradation over time is inevitable. Accordingly, the present invention aims to provide a drive method and a drive circuit for optimizing a drive condition according to variation and change in the characteristic of a discharge device to be driven, and to obtain stable emission characteristic over a long period.

Means for Solving the Problems

Briefly, the present invention is based on an idea in which a gas discharge device for a light source is driven in such way that, during a normal discharge operation, an alternating drive voltage to be applied between a pair of electrodes arranged to face an outer surface of a bottom part of an envelope constituting the gas discharge device is switched to a voltage Vs lower than a voltage Vo at an initial lighting (discharge) start-up. In addition, according to the present invention, a three-step initial drive sequence is employed in which a buffering period having a voltage increasing process of several cycles is set before a lighting (discharge) start voltage Vo is applied, and after a lighting period writing period) at the lighting (discharge) start voltage Vo, a stabilization period at a fixed voltage is set. After the initial drive sequence, a normal lighting (discharge) operation at a sustain voltage Vs is performed.

Such driving is enabled by using wall charges alternately accumulated on an electrode corresponding portion on an inner wall of the glass envelope constituting the gas discharge device for a light source, which is of an external discharge type and which is to be driven, according to a polarity inversion of the alternating drive voltage.

The switching of the drive voltage from Vo to Vs and the adjustment of the alternating voltage in the initial drive sequence can be achieved by switching an input direct-current voltage (DC) to an inverter circuit serving as a drive power source. Adjustment of the alternating drive voltage can be also achieved by changing a duty ratio of a signal for controlling a switching operation of the inverter circuit to control a value of a current supplied to a primary winding of a step-up transformer.

The present invention is also characterized by a drive method performing an automatic tune function for optimum drive frequency. The frequency of a drive voltage supplied to the gas discharge device for a light source from the step-up transformer in the inverter power supply constituting a drive circuit is swept within a fixed sweeping range at the initial lighting (discharge) start-up time, and a discharge voltage and a discharge current during sweeping are detected to automatically tune the frequency to an optimum frequency by feed-back control.

Due to this automatic tuning function, a troublesome adjusting operation for each light source device to be driven can be eliminated. Further, because of the automatic tuning operation being performed for every lighting operation, the device can constantly be driven under an optimum condition by following a characteristic change over an operating time.

In addition, the drive circuit according to the present invention is characterized in that an automatic frequency control circuit that automatically adjusts an output voltage and a drive frequency based on detected values of a discharge voltage and a discharge current is provided in a DC-AC inverter power supply circuit for driving the external electrode type gas discharge device for a light source.

The automatic frequency control circuit automatically adjusts the drive frequency to a resonance frequency of a resonance circuit determined by the gas discharge device as a capacitive load and an output inductance of the step-up transformer included in the inverter power supply circuit. This circuit sweeps a frequency within a predetermined range around a resonance point with a sine wave of a peak voltage V1, and sets an optimum drive frequency by feedback control of a discharge voltage and a discharge current detected during sweeping.

The tuning to the optimum drive frequency is performed every lighting operation, and after the tuning, control for switching the drive voltage Vo to the voltage Vs lower than the voltage Vo is performed. Such a voltage switching function is also incorporated into the control circuit.

In addition, in the present invention, as a means for adjusting emission intensity during normal lighting, a drive method for intermittently applying an alternating drive voltage at a predetermined burst cycle is used. The light emission intensity can be adjusted by changing a duty ratio between an application time and a suspension time of a drive voltage with the burst cycle being fixed. Also, the light emission intensity can be adjusted by changing the burst cycle with the duty ratio being fixed. Due to the light emission intensity adjustment means, the degradation in the light emission intensity due to aged deterioration of the discharge device can be compensated to enable a continuous stable operation.

Effect of the Invention

According to the present invention, only at the initial lighting start-up, a high drive voltage exceeding a discharge start voltage Vf is applied to the light source device constituted by the external electrode type gas discharge device to be driven, and thereafter, a normal light emission operation at a low drive voltage is performed. Therefore, compared to the case where the light source device is steadily driven by continuously applying a high drive voltage applied at the lighting start-up, an effect of prolonging the operating life of the gas discharge device and an effect of reducing power consumption can be obtained.

Further, according to one aspect of the present invention, the optimum drive condition is set every lighting, whereby stable light emission intensity can constantly be obtained by following a characteristic variation or a characteristic change of a gas discharge device or an ultraviolet light source device to be driven over time or according to an environmental variation.

According to another aspect of the present invention, a function of adjusting light emission intensity is added to the drive circuit associated with the light source device using the gas discharge device, whereby degradation in the light emission intensity due to deterioration of the light source device can be compensated to thereby obtain stable light emission intensity over a long term.

Accordingly, the present invention can provide a light source module, particularly an ultraviolet light source module, which is mercury-free, operates in a stable manner, and has a flat light-emission configuration, thereby being capable of broadening an application field such as medical use, disinfection/sterilization use, industrial use such as photo exposure, and plant growth use.

EMBODIMENTS OF THE INVENTION

Figure 1:
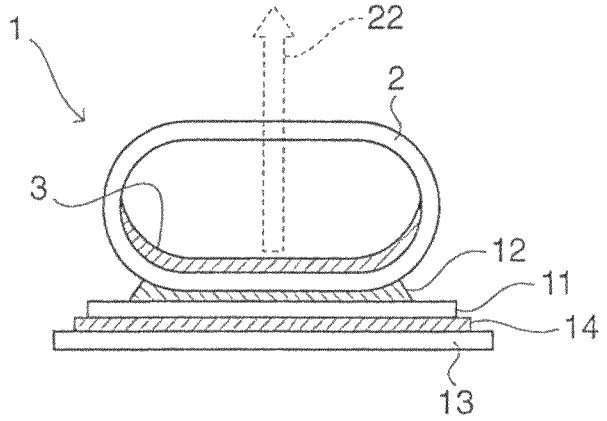
FIG. 1 shows a transverse sectional view and a perspective view for describing a basic configuration of an ultraviolet light-emitting gas discharge tube and a light source device using the same according to a first embodiment of the present invention.
Figure 1:
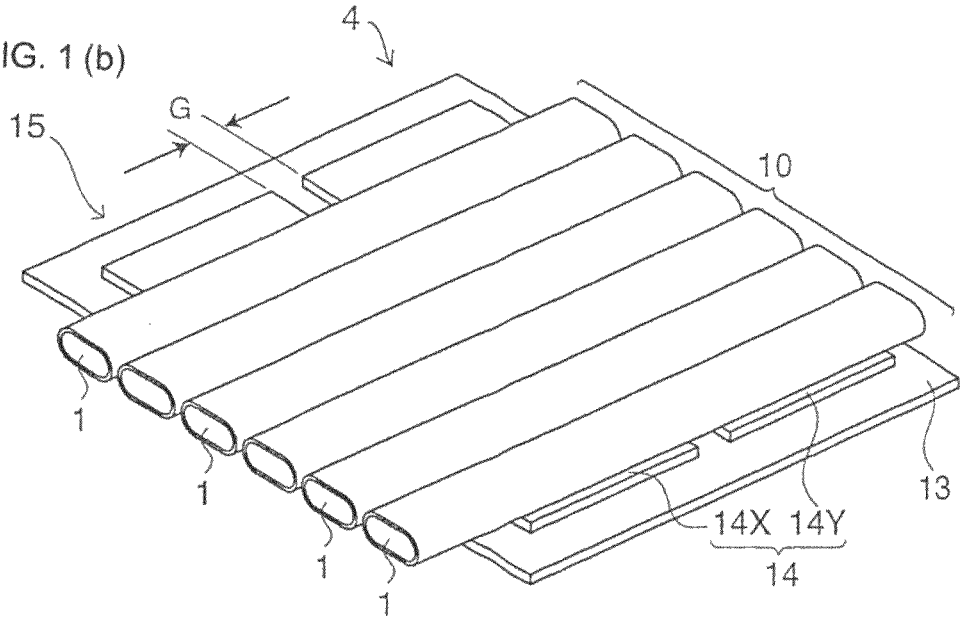

Preferable embodiments of the present invention will be described below in detail with reference to the drawings. It is to be noted that, for simplifying the description, the same components are identified by the same reference numerals. In addition, while a discharge electrode for a gas discharge device for a light source which is to be driven is sometimes referred to as a "long electrode" for the sake of convenience, this term is not used to limit the length of the electrode.

First Embodiment

FIG. 1 shows explanatory views for describing, as a first embodiment of the present invention, a basic configuration of an ultraviolet light-emitting gas discharge device having a tube configuration, and a basic configuration of a flat light source device obtained by arraying a plurality of the ultraviolet light-emitting gas discharge tubes.

[Light Source Device Provided with Gas Discharge Tubes]

FIG. 1(*a*) is a sectional view of an ultraviolet light-emitting gas discharge tube.

As shown in FIG. 1(*a*), the ultraviolet light-emitting gas discharge tube (hereinafter referred to as a light-emitting tube) 1 has, as a main component, an elongate glass tube 2 serving as an envelope and having a flat-oval transverse section. The glass tube 2 is provided with an ultraviolet phosphor layer 3 on the inner bottom surface thereof, and filled with a discharge gas obtained by mixing neon and xenon, and both ends of the glass tube being sealed.

The glass tube 2 is a thin tube formed from an inexpensive borosilicate glass material containing silicon oxide ($SiO_2$) and boron oxide ($B_2O_3$) as a main component and having, for example, a flat-oval cross-section with a major axis of about 2 mm and a minor axis of about 1 mm. The thickness of the glass tube 2 is limited to be 300 μm or less to achieve satisfactory transmittance with respect to ultraviolet light of UV-B and UV-C wavelength bands. Obviously, a quartz having excellent ultraviolet light transmittance may be used for the material of the glass tube 2.

If a gadolinium-activated phosphor ($LaMgAl_{11}O_{19}$:Gd) is used as one example of the ultraviolet light-emitting phosphor layer 3, emission of ultraviolet light with 311 nm which is a wavelength range of UV-B band effective for industrial use or medical use can be obtained. If a praseodymium-activated phosphor ($YBO_3$:Pr or $Y_2SiO_5$:Pr) is used, emission of ultraviolet light with 261 nm or 270 nm which is a wavelength range of UV-C band effective for disinfection and sterilization can be obtained. If quartz having excellent ultraviolet transmittance is used for the material of the glass tube, a light-emitting tube which directly uses 143 nm or 173 nm vacuum ultraviolet light (VUV) emitted by the discharge of a xenon gas component can be obtained without using the phosphor layer described above. Note that the light-emitting tube 1 emits light in the direction of an arrow 22 in FIG. 1(*a*).

[Flexible Flat Light Source Device]

FIG. 1(*b*) is a perspective view of a flat emission type light source device 4 according to the present embodiment.

As shown in FIG. 1(*b*), a plurality of the light-emitting tubes 1 shown in FIG. 1(*a*) having the glass tube 2 as a main component is arranged parallel to one another in the direction crossing the longitudinal direction of the light-emitting tube 1 to construct the light source device 4 having an array structure.

In FIGS. 1(*a*) and 1(*b*), each of the light-emitting tubes 1 constructing the light-emitting tube array structure 10 is disposed on a thin (several 10 μm) heat-resistant insulating film 11 by means of an adhesive agent 12 having excellent thermal conductivity, such as a silicon resin, in a releasably adhering state. A gap with the same size or partially different size is formed between the adjacent light-emitting tubes 1 for enabling the light source device 4 to be bent.

On the other hand, an electrode assembly 15 constituted by a flexible insulating substrate 13 formed from, for example, a polyimide resin, and a pair of electrodes 14 formed thereon is provided below the light-emitting tube array assembly 10 in an adhering (non-fixed) state.

A pair of electrodes 14 includes a band-shaped X electrode 14X and Y electrode 14Y which face the back surface on the bottom part of the light-emitting tube 1 constructing the light-emitting tube array assembly 10 and extend to either side with a common electrode gap or slit G formed therebetween.

Specifically, the X electrode 14X and the Y electrode 14Y have, as a whole, a common electrode pattern extending in a direction crossing the longitudinal direction of each light-emitting tube. On the other hand, with respect to the individual light-emitting tube 1, the pair of electrodes 14 has a configuration of a pair of long electrodes extending in either side along the longitudinal direction of the light-emitting tube 1 in a symmetrical manner with an electrode gap G of about 0.1 to 10 mm for generating an initial discharge in the tube being formed therebetween. The length of each of the X electrode 14X and the Y electrode 14Y along the longitudinal direction of the tube is five to 10 times or more of the width of the electrode gap G.

If the light-emitting tube array structure 10 shown in FIG. 1(*b*) is constructed by arraying, at an interval of 1 mm, twenty light-emitting tubes 1 each of which is formed from a thin glass tube having a length of 5 cm and having a flat-oval cross-section with a major axis of 2 mm and a minor axis of 1 mm, the X electrode 14X and the Y electrode 14Y are formed to extend to either side, with the discharge slit G of 3 min formed therebetween, in a pattern of extending in the direction crossing the light-emitting tubes 1 with a width of 23.5 mm.

Thus, the back side of the light-emitting surface of $5\times6=30$ $cm^2$ is almost covered by the electrode surface except for the gap of $0.3\times6=1.8$ $cm^2$ corresponding to the width of the electrode slit G. The covering percentage of the electrode with respect to the light-emitting area is about 94%.

The X electrode 14X and the Y electrode 14Y may be directly formed on the insulating substrate 13 by printing conductive ink such as a silver paste or the like, or may be formed by adhering or bonding a metal conductive foil, such as a copper foil or an aluminum foil, which has been shaped in advance. It is also obvious that the pair of electrodes can be obtained by patterning a conductive layer formed on the insulating substrate 13.

If a transparent fluoroplastic such as Teflon (registered trademark) is used for the insulating film 11 supporting the light-emitting tubes 1 in an array, the X and Y electrodes 14X and 14Y are preferably formed from a material having high light reflection characteristic, and for this point, it is effective to use an aluminum foil in particular.

In this case, the electrode slit G may be a window open downward, so that emitted ultraviolet light may exit to the back side. Therefore, it is preferable that the portion corresponding to the electrode slit G is closed by an insulating material having light reflection characteristic equal to that of the electrode material, such as a reflection tape.

In addition, the gas discharge light-emitting tubes 1 may be arranged by directly providing an adhesive insulating layer made of a silicon resin or the like on the insulating substrate 13 on which the X electrode 14X and the Y electrode 14Y are formed. Because the light-emitting tube array assembly 10 and the electrode assembly 15 are not bonded (not fixed) to each other, tensile force applied to the insulating substrate 13 for bending a flexible flat light source device can be absorbed.

Figure 2:
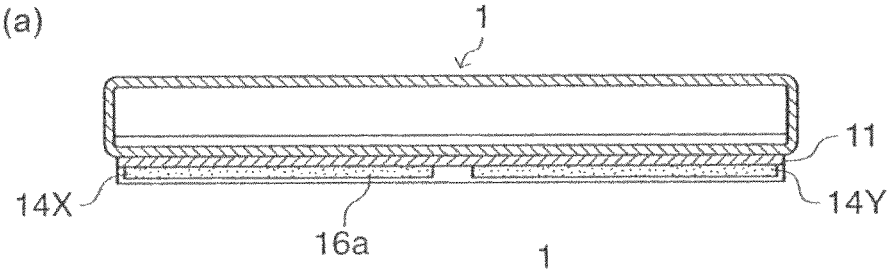
FIG. 2 shows a longitudinal sectional view and a back view showing a structural example of the light source device shown in FIG.
Figure 2:
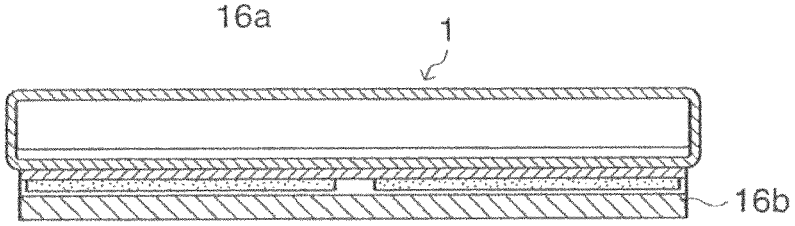
Figure 2:
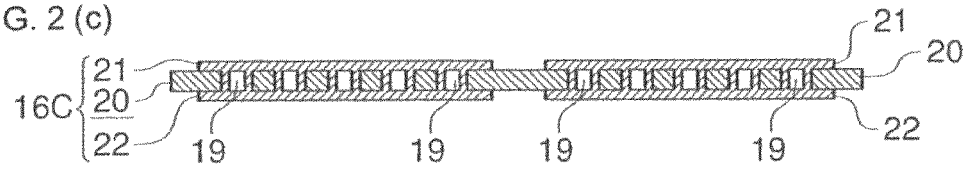
Figure 2:
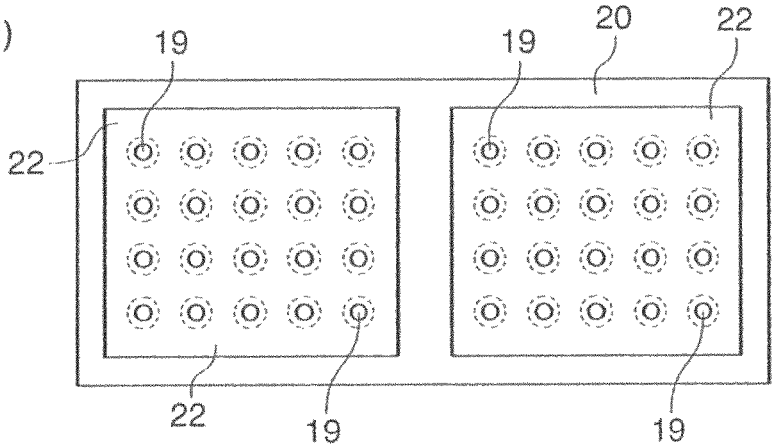
Figure 2:
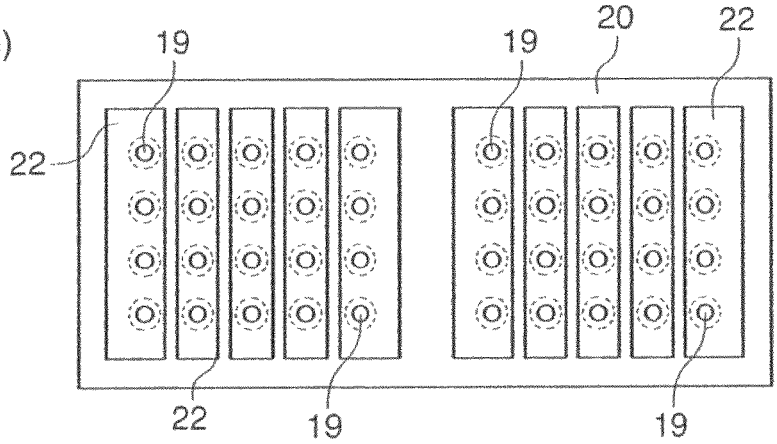

FIGS. 2(*a*), (*b*), (*c*), (*d*), and (*e*) are each a longitudinal sectional view and a back view showing a specific structural example of the light source device 4 according to the present embodiment. In the embodiment in FIG. 2(*a*), multiple light-emitting tubes 1 are arranged on the polyimide insulating film. 11 having, formed on the lower surface thereof, the patterns of the X electrode 14X and the Y electrode 14Y made of a copper or aluminum foil, so as to be parallel to one another by means of a thermal conductive adhesive agent such as a silicon resin in a releasable manner. Further, the back surface of the pair of electrodes 14X and 14Y is covered by a heat-resistant insulating film 16*a*, whereby a film-shaped flexible surface light source device is completed.

As another flat light source configuration, as shown in FIG. 2(*b*), a hard plate-shaped light source device conforming to the shape of the substrate surface is obtained by adhering an insulating back surface supporting substrate 16*b* formed from glass, ceramics, or resin to the back side of the film-shaped light source device shown in FIG. 2(*a*).

In addition, in place of the back surface supporting substrate 16*b*, a heat dissipation substrate 16*c* shown in FIG. 2(*c*) may be provided. As is more apparent in relation to the back view in FIG. 2(*d*), the heat dissipation substrate 16*c* has, as a base, an insulating base material 20 made of a resin, glass, or ceramics and formed with metal (for example, copper) through-holes 19 to an extent not impairing the rigidity, and metal. (for example, copper) pattern layers 21 and 22 for heat dissipation formed on both surfaces of the insulating base material 20 with patterns almost the same as the electrode patterns 14X and 14Y. The metal patterns 21 and 22 for heat dissipation can be divided into islands, as shown in FIG. 2(*c*), so as to correspond to the through-holes to prevent the generation of a high voltage due to capacity coupling with the electrodes 14X and 14Y.

[Flat Light Source Device Having a Gas Discharge Panel Configuration]

Figure 3:
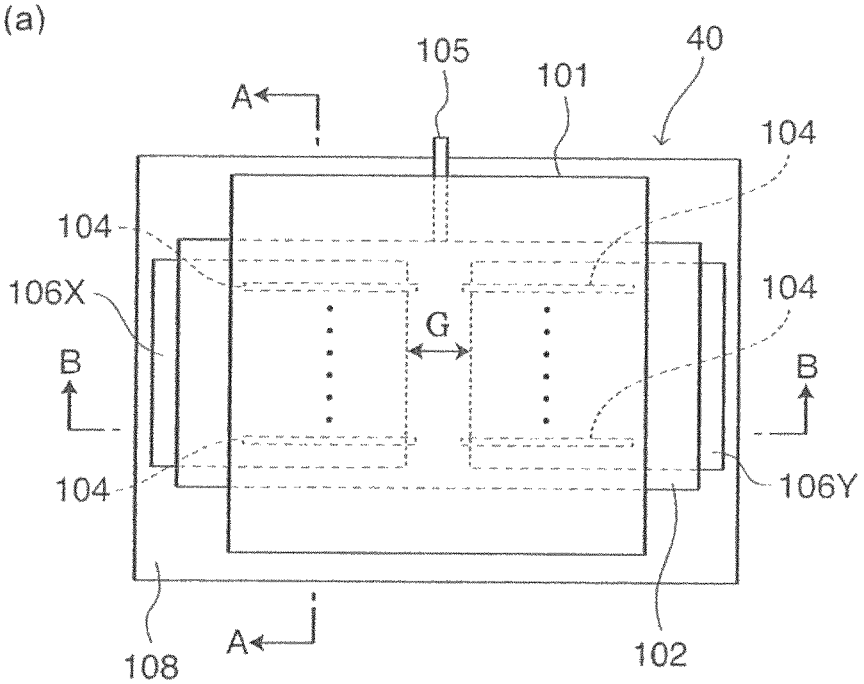
FIG. 3 shows a plan view, a transverse sectional view, and a longitudinal sectional view showing a gas discharge device of a panel configuration as a modification of the light source device.
Figure 3:
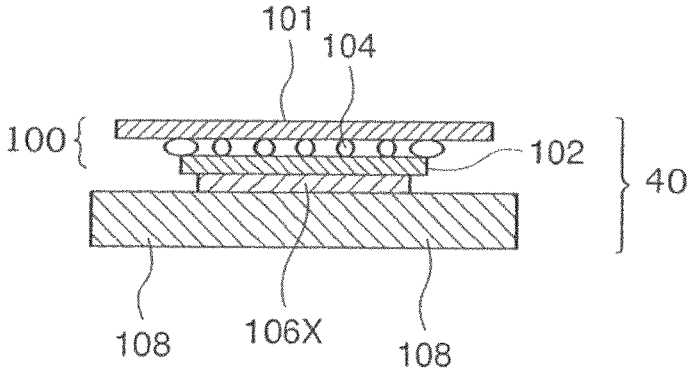
Figure 3:
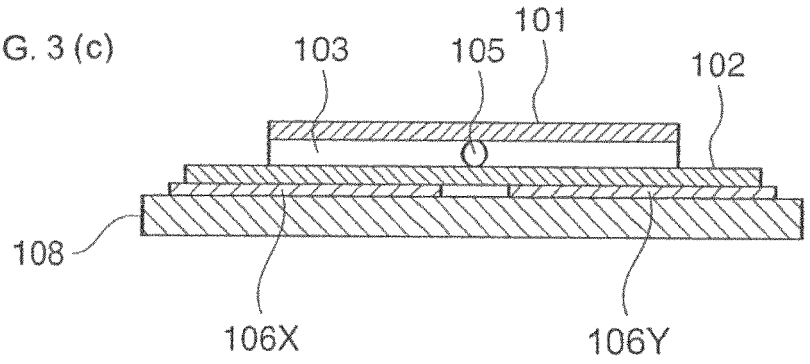

The flat light source device to be driven according to the present invention may have a panel configuration as well as the above-described tube array configuration obtained by arraying multiple light-emitting tubes 1. FIG. 3(*a*) is a plan view for describing a flat light source device 40 having such a panel configuration, and FIGS. 3(*b*) and 3(*c*) are sectional views taken along a line A-A and B-B as viewed from arrows.

The configuration of this flat light source device 40 is substantially the same as the configuration obtained by replacing the light-emitting tube array assembly 10 shown in FIG. 1(*b*) by one panel envelope 100. In FIG. 3, the panel envelope 100 has a front substrate 101 and a back substrate 102, and a gas sealed space 103 is formed therebetween. The gas space 103 is partitioned into a plurality of stripe-shaped discharge channels by spacers 104 such as glass rods, and the periphery of the gas space 103 is also sealed by similar glass rods. In addition, an exhaust pipe 105 is provided to communicate with a common space corresponding to a trigger discharge gap (electrode slit) G crossing the central space between the rod-shaped spacers 104.

The front substrate 101 is formed from a quartz glass plate or a heat-resistant microglass sheet with a thickness of 300 μm or less, which transmits ultraviolet light. The back substrate 102 is also formed from quartz glass or a heat-resistant microglass sheet, and has a pair of electrodes 106X and 106Y formed on the back side thereof and an ultraviolet phosphor layer (not shown) formed on the inner surface thereof.

Further, a support substrate 108 made of glass or ceramics is adhered to the back side of the back substrate 102 by means of an adhesive agent having excellent thermal conductivity so as to sandwich the pair of electrodes 106X and 106Y therebetween. The pair of electrodes 106X and 106Y may be formed on the support substrate 108. The support substrate 108 has a function of supporting the glass panel envelope 100 constituted by thin front substrate 101 and back substrate 102, and also has a function of an electrode substrate and a heat dissipation plate. The back surface of the support substrate 108 may be lined with a metal sheet made of copper or aluminum to enhance heat dissipation effect, as in the heat dissipation substrate 16*c* in the light source device having the light-emitting tube array configuration shown in FIG. 2.

When the gas discharge device having the panel configuration described above is used as the flat light source device 40, this device can also be driven in the same manner as the previously described light source device 4 having the light-emitting tube array configuration. The pair of electrodes 106X and 106Y is not necessarily formed to have the illustrated common solid pattern. The pair of electrodes 106X and 106Y may be formed as stripe patterns extending in either side along the longitudinal direction of the gas discharge channels partitioned by the spacer 104 in a stripe pattern so as to correspond thereto.

[Electrode Connection and Equivalent Circuit]

Figure 4:
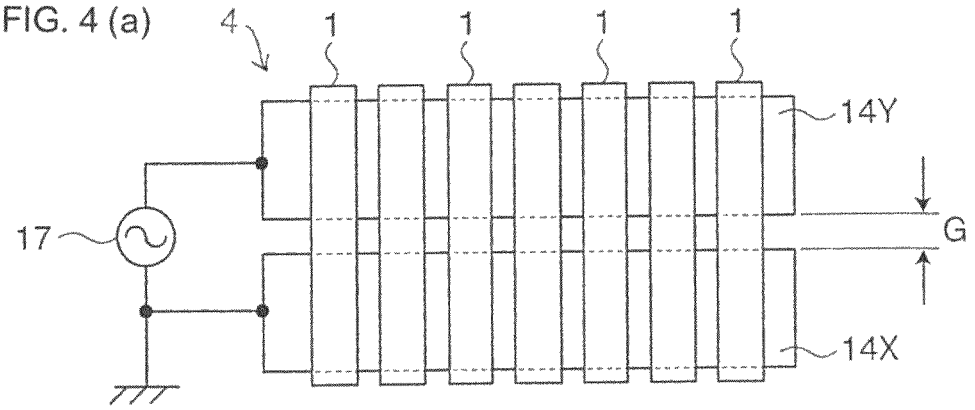
FIG. 4 shows an electrode connection diagram and an equivalent circuit diagram of the light source device shown in FIG. 1.
Figure 4:
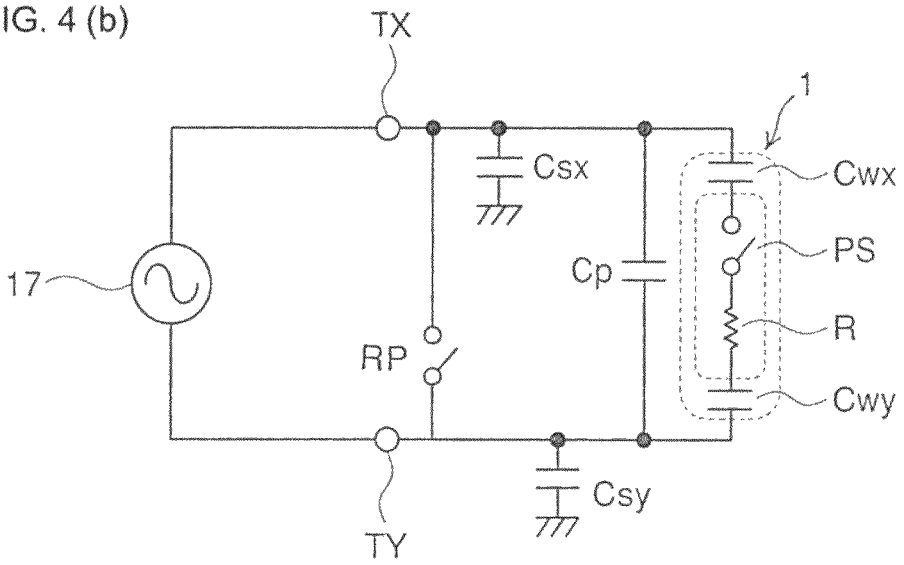

FIG. 4(*a*) is a schematic plan view of the light source device 4 having a light-emitting tube array configuration. The above-mentioned light source device 4 having the tube array configuration or the flat light source device 40 having the panel configuration are both an external electrode type, and basically driven by a sine wave voltage. Specifically, taking the light source device 4 having the tube array configuration as a representative example, a drive power source 17 is connected so as to apply a sine wave voltage to the Y electrode 14Y with the X electrode 14X common to the light-emitting tubes 1 being grounded, as shown in FIG. 4(*a*).

FIG. 4(*b*) shows an equivalent circuit of the light source device 4 shown in FIG. 4(*a*). An equivalent circuit of the flat light source device 40 having the panel configuration shown in FIG. 3 is substantially the same as the equivalent circuit shown in FIG. 4(*b*). The electric circuit elements of the light-emitting tube 1 include a discharge switch PS, an internal resistor R, and capacitances Cwx and Cwy of the insulating film 11 and the glass tube 2.

An interelectrode capacitance Cp of the X and Y electrodes 14X and 14Y is connected in parallel with the circuit elements of the light-emitting tube 1, and parasitic capacitances Csx and Csy are present between each of these electrodes and the ground.

The drive power source 17 that outputs a high voltage of a sine wave is connected to electrode terminals TX and TY. A high-impedance leakage path RP which can be regarded as an almost open state in a strict sense is also present between both terminals TX and TY.

As described above, the light source device 4 is a capacitance load. Therefore, if the drive power source 17 is composed of an inverter power supply, an inductance of an output winding of a step-up transformer is connected in parallel with the drive terminals TX and TY of the light source device 4, so that a parallel resonance circuit is constructed as a whole. Accordingly, it is preferable that the light source device 4 is driven by a resonance frequency including the power supply circuit.

As described later, according to the present invention, the frequency of the sine wave drive voltage is swept upon lighting between 20 kHz and 50 kHz which have been determined in advance based on the relationship between the total load capacitance in the equivalent circuit in FIG. 4(*b*) and the output inductance of the inverter power supply, and is set to a resonance frequency of 25 kHz, for example.

In addition, the peak voltage upon initial lighting is more than. 1000 V which is higher than the discharge start voltage of the gas space corresponding to the electrode slit G (FIG. 4(*a*)), and it is determined in 2E consideration of the balance between the length of the discharge expansion on the electrodes 14X and 14Y and prevention of damage due to a discharge exceeding the breakdown voltage of the electrode slit G.

[Discharge Model]

Figure 5:
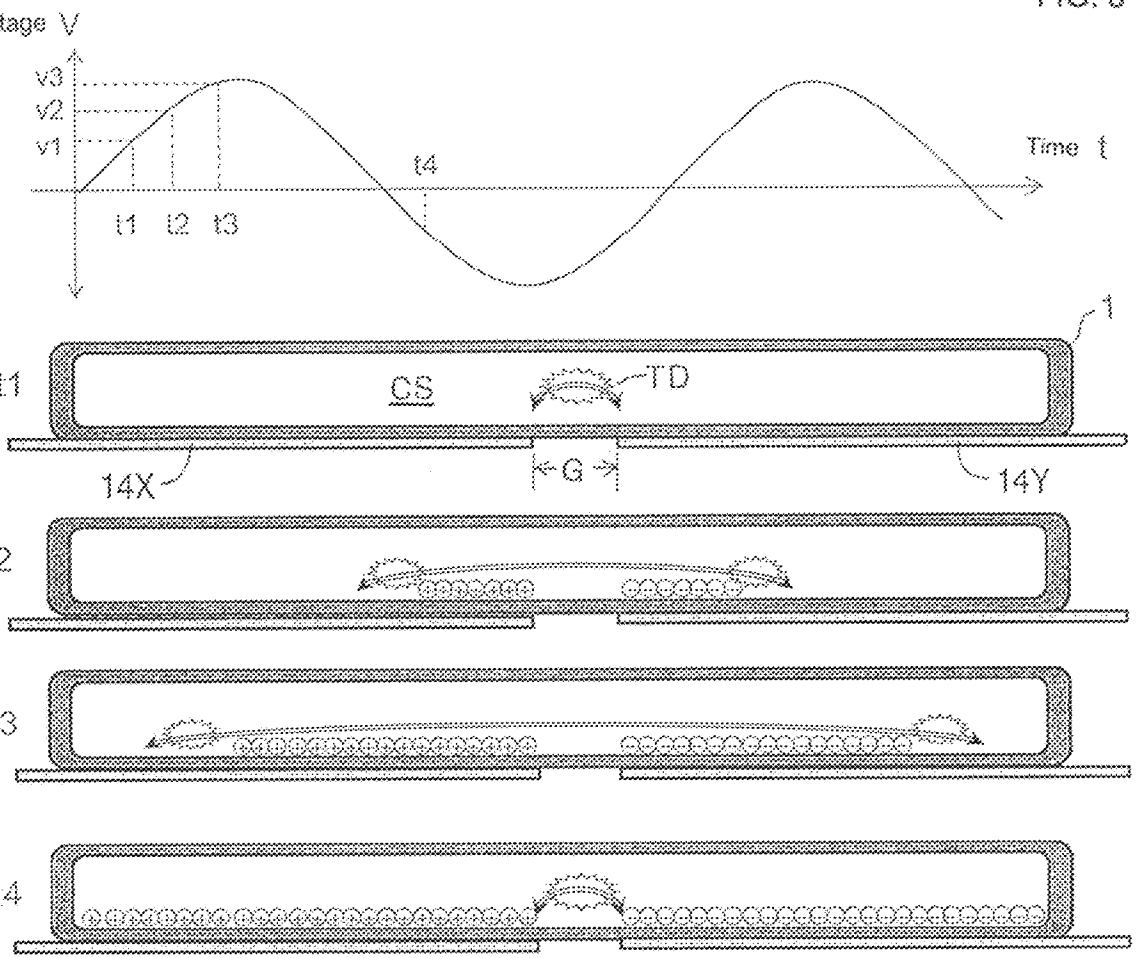
FIG. 5 is a schematic diagram showing a discharge model of the ultraviolet light-emitting gas discharge tube shown in FIG. 1 in a time-series manner.

FIG. 5 is schematic view showing, in a time-series manner, a discharge model of the light-emitting tube 1 to be driven according to the present invention. The sine wave voltage shown in FIG. 5(*a*) is applied between the long electrodes 14X and 14Y. When a voltage V1 in the increasing process of the sine wave voltage shown in FIG. 5(*a*) exceeds a discharge start voltage Vf of a discharge space CS corresponding to the electrode slit G between the long electrodes 14X and 14Y at a timing t1, a trigger discharge TD occurs on the corresponding portion.

Due to the trigger discharge TD, a large number of space charges are supplied to the neighboring gas space, by which a so-called priming effect is caused. Thus, the discharge expands along the longitudinal direction of the long electrodes 14X and 14Y with the increase in voltage of the sine wave, and grows to a so-called long-distance discharge.

Simultaneously, charges (electrons (−) and plus ions (+)) having a polarity opposite to the polarity of the applied voltage are accumulated as wall charges on an inner wall surface of the discharge tube 1 corresponding to the electrode slit G that initially generates the trigger discharge TD, and the electric field caused by this wall charges cancels the electric field caused by the applied voltage. Thus, the discharge in the portion corresponding to the electrode slit G is stopped.

FIGS. 5(*b*), (*c*), (*d*), and (*e*) schematically show the discharge and the accumulation state of the wall charges corresponding to timings t1 to t4 of the applied sine wave voltage illustrated in FIG. 5(*a*).

It can be understood from this discharge model that the trigger discharge TD generated in the portion corresponding to the electrode slit G at the timing t1 is extended along the extending direction of the long electrodes 14X and 14Y at the timings t2 and t3 during the increasing process of the applied voltage, accompanied by the accumulation of the wall charges.

Charges (electrons (−) and plus ions (+)) having a polarity opposite to the polarity of the applied voltage are accumulated as wall charges, and the internal electric field caused by the wall charges cancels the electric field caused by the externally applied voltage. Thus, the generated discharge is sequentially stopped.

Accordingly, when the polarity of the applied sine wave drive voltage is inverted, the internal electric field caused by the wall charges is combined with the electric field caused by the externally applied voltage, with the result that the discharge is again started at the portion corresponding to the electrode slit G, and then, expansion and stop of the discharge with the increase in the applied sine wave voltage in the opposite direction proceed toward either end of the pair of long electrodes 14X and 14Y in the same manner as described above. Due to the repetition of this operation, the gas discharge and light emission due to the gas discharge are performed. The wall charges mentioned here are combined with the inverted applied voltage after the start of the discharge as described above, and therefore, the discharge can be continued even if the applied voltage is dropped. This discharge model is described in more detail in Japanese Patent Application No. 2015-148622 (JP2017-27912A) previously filed by the present inventors.

[Drive Circuit]

Figure 6:
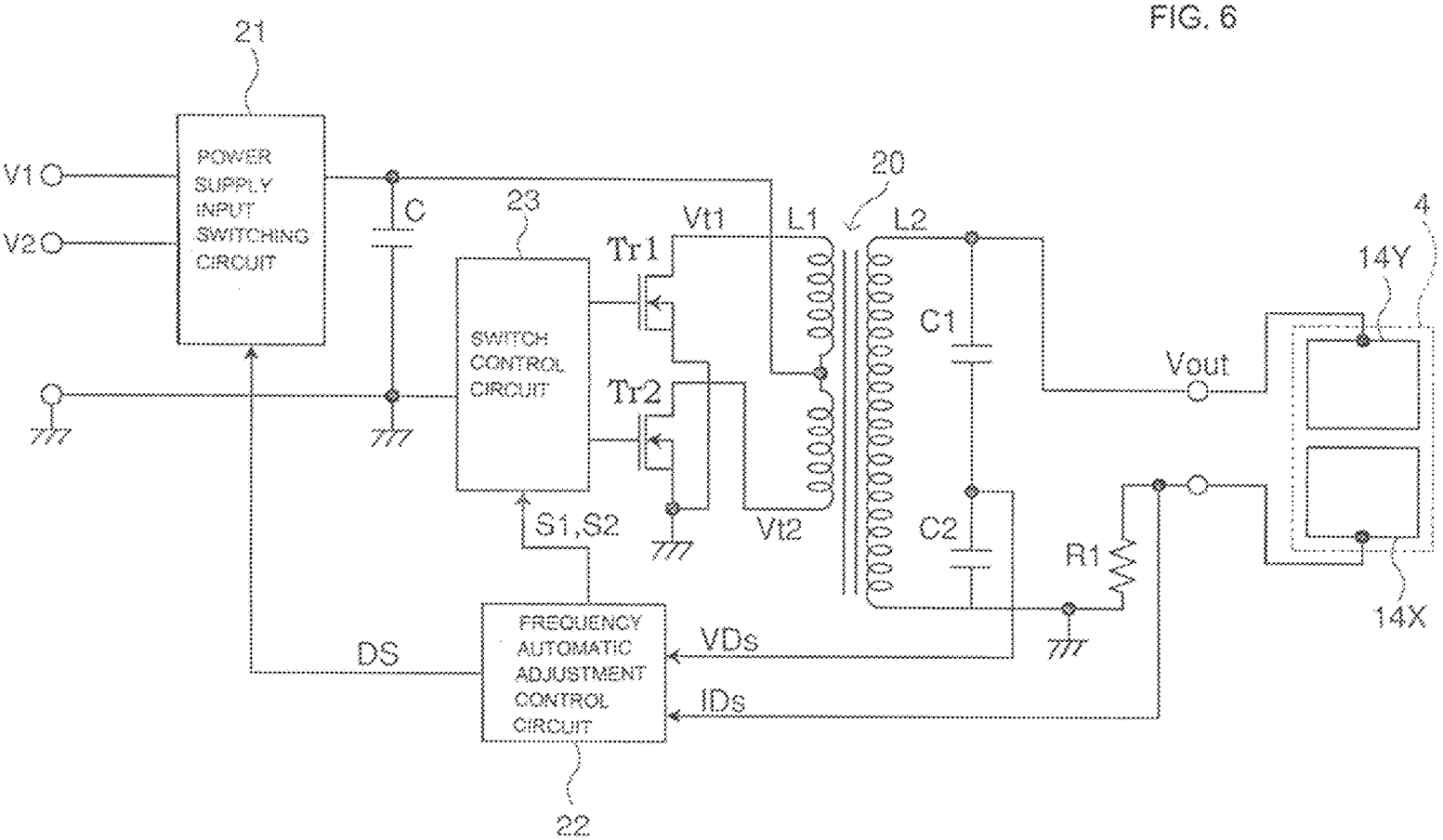
FIG. 6 is a block diagram showing a drive circuit according to the first embodiment of the present invention.

The drive circuit according to the present embodiment is shown in FIG. 6. This drive circuit has a configuration of the inverter power supply connected to the light source device 4 which is shown as a representative example and obtained by arraying multiple light-emitting tubes 1. Specifically, a secondary winding L2 of the step-up transformer 20 is connected to the light source device 4, and switching transistors Tr1 and Tr2 that convert a DC voltage from a power supply input switching circuit 21 into an AC voltage are connected to the primary winding L1 of the step-up transformer 20. Further, similar to a normal inverter power supply circuit, capacitors C, C1, and C2 and a resistor R1 are connected as shown in FIG. 6 as appropriate.

The on-off control of the switching transistors Tr1 and Tr2 that determine a drive frequency is performed by frequency control signals S1 and S2 given to a switch control circuit 23 from a frequency automatic adjustment control circuit 22.

A drive voltage detection signal VDs and a drive current detection signal IDs are fed back to the frequency automatic adjustment control circuit 22, as control signals, from an output side of the step-up transformer 20. Further, a power supply switching signal DS is given to the power supply input switching circuit 21 from the frequency automatic adjustment control circuit 22.

Figure 7:
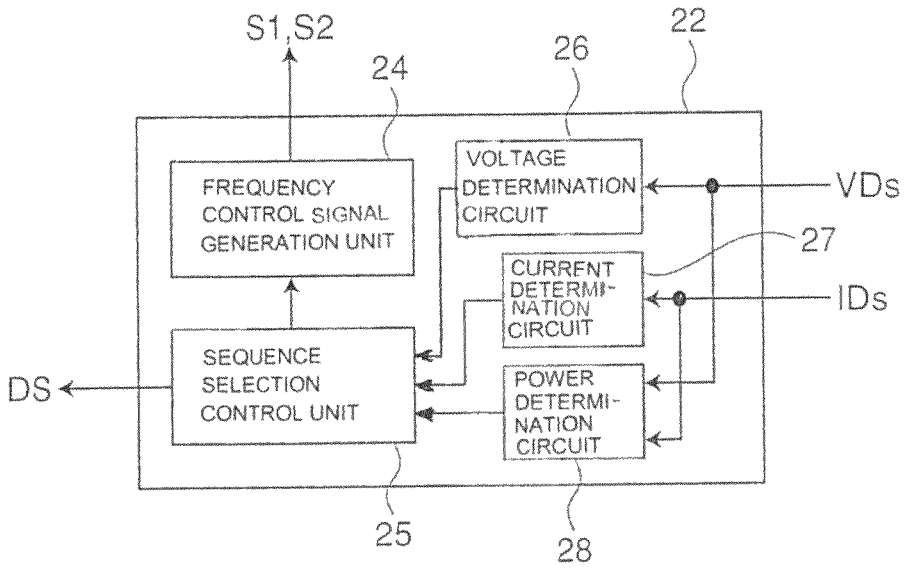
FIG. 7 is a block diagram showing a configuration of a frequency automatic adjustment control circuit shown in FIG. 6.

As shown in a block diagram in FIG. 7, the frequency automatic adjustment control circuit 22 has, as main components, a frequency control signal generation unit 24 including a voltage control oscillating circuit (VCO) and a sequence selection control unit 25. Connected to the sequence selection control unit 25 are a voltage determination circuit 26 that determines a voltage during resonance with a drive voltage detection signal VDs being an input, a current determination circuit 27 that determines a current during resonance with the drive current detection signal IDs being an input, and a power determination circuit 28 that determines electric power during resonance from both signals VDs and IDs. The sequence selection control unit 25 generates a control signal to the frequency control signal generation unit 24 and a control signal DS to the power supply input switching circuit 21 in response to the outputs from these circuits.

Figure 8:
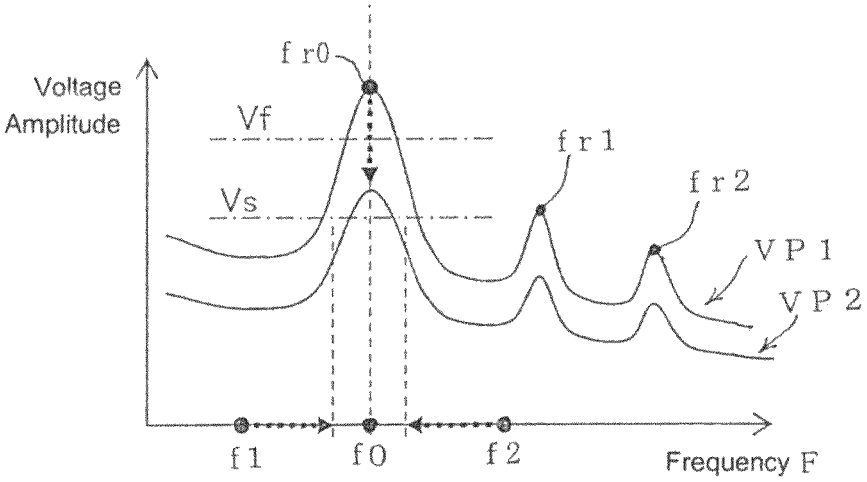
FIG. 8 is a line chart showing a frequency characteristic of the light source device shown in FIG. 1.

FIG. 8 is a diagram showing typical frequency characteristics of the light source device 4 connected to the drive circuit having the inverter power supply configuration shown in FIG. 6. FIG. 8 shows a characteristic curve VP1 with a peak exceeding the discharge start voltage Vf at the electrode gap G and a characteristic curve VP2 with a peak voltage exceeding a sustain voltage Vs lower than. Vf due to the effect of wall charges, wherein a common resonance point fr0 where the voltage on the vertical axis increases with the increase in the frequency F on the horizontal axis appears in both curves. Weak resonance points fr1 and fr2 corresponding to harmonics of the resonance frequency f0 also appear at frequencies higher than the frequency at the resonance point fr0.

Figure 9:
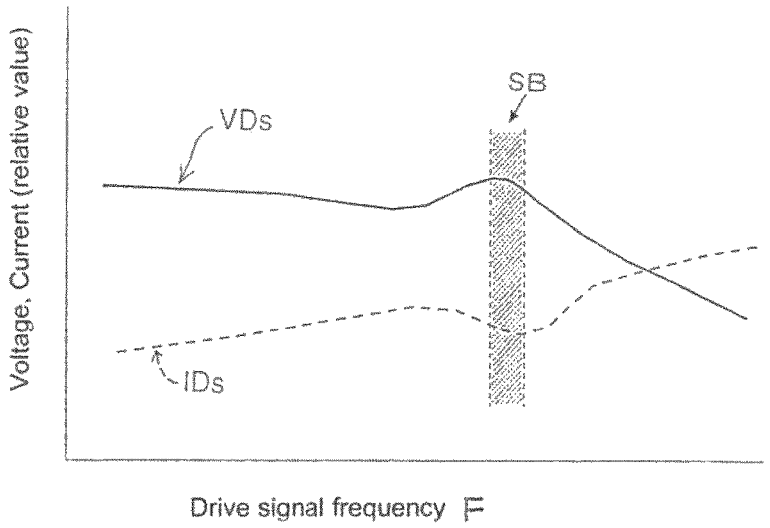
FIG. 9 is a line chart showing a change in relative detection signals, respectively corresponding to a drive voltage and a drive current, caused by a change in a drive frequency in the first embodiment.

Therefore, the resonance frequency f0 can be selected by roughly predicting the resonance point mentioned above and sweeping the frequency around the frequency at the resonance point within the range between f1 to f2. FIG. 9 is a graph for describing the operation principle for selecting the resonance frequency, wherein the changes in the drive voltage detection signal VDs and the drive current detection signal IDs relative to the sweeping of the drive signal frequency F on the horizontal axis are represented by a relative value.

When the drive signal frequency F is increased, the drive current detection signal. IDs tends to increase, and a region where a current loss is reduced appears at a certain frequency. In addition, the drive voltage detection signal VDs tends to decrease with the increase in the frequency F, but a region where the drive voltage detection signal VDs increases appears at a certain frequency.

That is, when the drive signal frequency F is increased, a voltage change and current change according to the frequency characteristics determined based on the inductance component of the step-up transformer 20, the interelectrode capacitance or the floating capacitance of the light source device, etc. occur. When the drive signal frequency F is increased, the current tends to increase, but there is a frequency at which a current loss is reduced. Further, the amplitude voltage which tends to decrease when the frequency is increased has a characteristic such that there is a peak where it increases at a specific frequency.

As a result, it is understood from FIG. 9 that the frequency regions where the current detection signal IDs and the voltage detection signal VDs greatly change overlap each other in a common frequency range SB around the resonance frequency f0 as indicated by a hatched line in FIG. 9.

Figure 10:
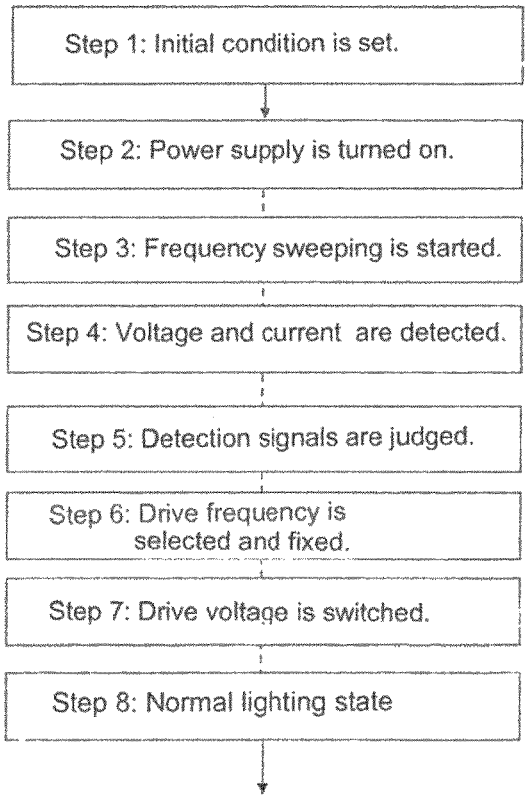
FIG. 10 is a flowchart for describing an operating sequence of a drive method according to the first embodiment.

Hereinafter, the operation of the drive circuit shown in FIGS. 6 and 7 will be described with reference to an operation flowchart shown in FIG. 10 and a drive waveform chart shown in FIG. 11.

A predicted resonance frequency predicted based on a rough capacitance of the light source device 4 and the leakage inductance of the secondary winding L2 of the step-up transformer 20 and a sweeping condition such as a frequency sweeping range of about 10 kHz around the predicted resonance frequency of 25 kHz, for example, are set in advance to the sequence selection control unit 25 (FIG. 7) in the drive circuit as an initial condition (step 1).

When the power supply is turned on in the power supply input switching circuit 21 (FIG. 6), the DC power supply of voltage V1 (for example, 12 V) is firstly turned on (step 2), and then, according to the operation order set in advance to the sequence selection control unit 25 in FIG. 7, a frequency-variable basic clock signal F0 is transmitted from the VCO included in the frequency control signal generation unit 24 (FIG. 7) from a frequency lower than the frequency at the resonance point so as to sweep the frequency within a predetermined sweeping range, for example, the predetermined range SB shown in FIG. 9 (step 3). For the sake of convenience, FIG. 11 does not show the change at a cycle T0 in the basic clock signal F0 due to the frequency sweeping.

Figure 11:
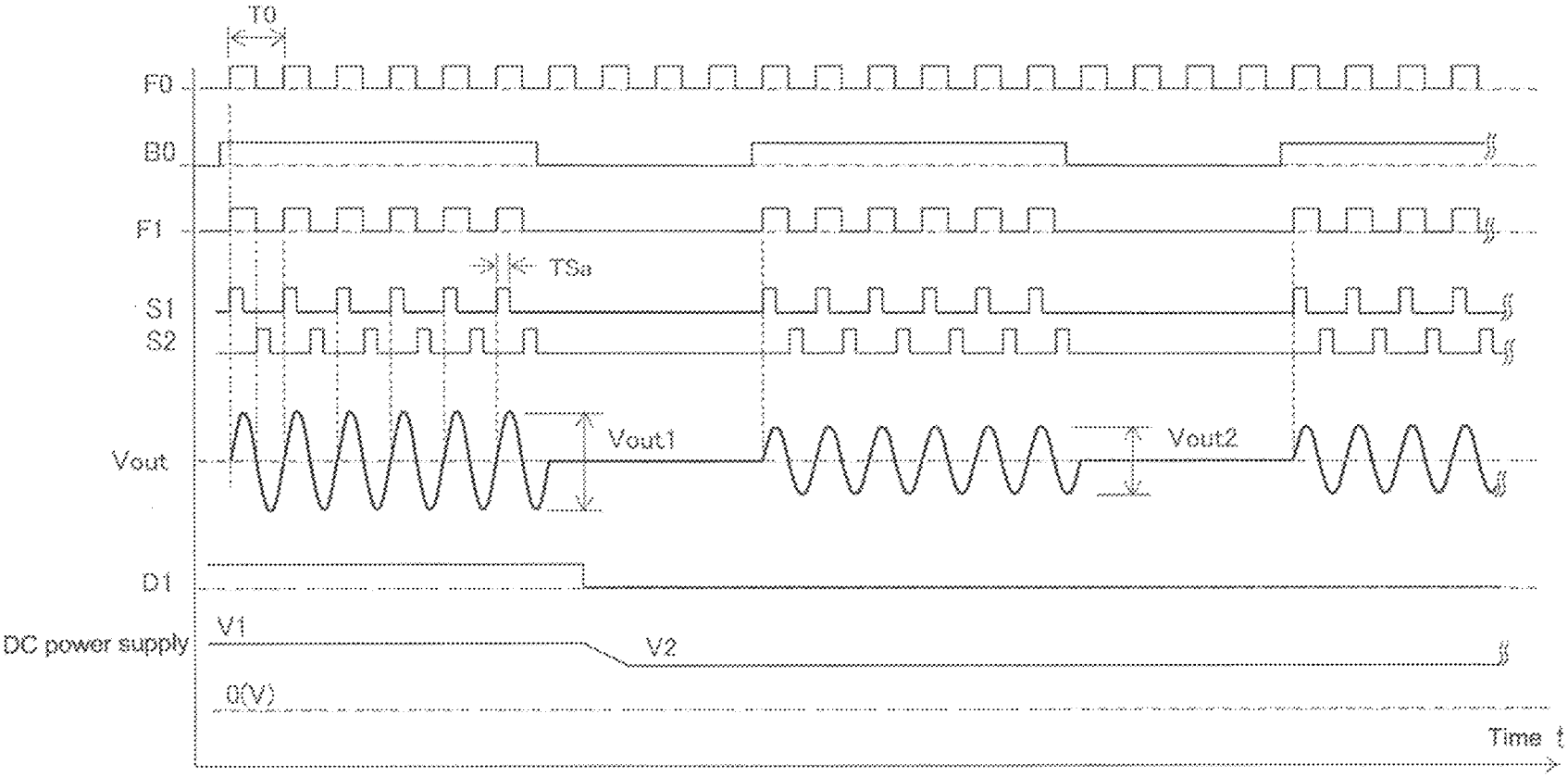
FIG. 11 is a time chart of an operating waveform for describing the drive method shown in FIG. 10.

During this period, the sequence selection control unit 25 (FIG. 7) generates a burst signal B0 having a frequency of about 100 to 1000 Hz with a duty ratio of 3:2, and the basic clock signal F0 is converted into a clock signal F1 which is temporarily interrupted at a burst cycle, as shown in FIG. 11.

At the rising tinning and the falling timing of the clock signal F1, frequency control signals S1 and S2 having a pulse width TSa and different phases are created. These frequency control signals S1 and S2 are both given to gate electrodes of the transistors Tr1 and Tr2 through the switch control circuit 23 (FIG. 6) to alternately switch the on/off state of both transistors.

Thus, the direction of a current flowing from the midpoint of the primary winding L1 of the step-up transformer 20 is inverted in an alternating manner, and the sine wave drive voltage Vout boosted according to the winding ratio is applied to the Y electrode 14Y of the light source device 4 from the output terminal of the secondary winding L2.

If the burst frequency of the drive voltage Vout relative to the light source device 4 is 100 Hz, the time for one cycle is 10 ms. Therefore, if the duty is set to be 3:2, the time for applying the drive voltage in one burst cycle is 6 ms. Accordingly, a sweeping signal for sweeping the oscillating frequency is supplied to the VCO in the frequency control signal generation unit 24 (FIG. 7) from the sequence control circuit 25 during, for example, the drive voltage application period (burst length) in the first burst cycle.

As a result, the cycle T0 of the frequency-variable basic clock signal F0 is changed, resulting in that the frequency of the drive voltage Vout is also swept. The sweeping operation described above for searching the resonance point is not limited to be performed in the first cycle of the burst signal B0, and may be performed over a plurality of cycles.

With the application of the drive voltage Vout and the frequency sweeping, the operation for detecting the change in the voltage and current due to the discharge operation of the light source device 4 is started (step 4). Then, the peak values in the change in the detection signals VDs and IDs and the drive frequency corresponding to these values are respectively determined by the voltage determination circuit 26, the current determination circuit 27, and the power determination circuit 28 shown in FIG. 7 (step 5).

The determination signals from the respective determination circuits are fed back to the sequence selection control unit 25 (FIG. 7), and the VCO in the frequency control signal generation unit 24 is controlled such that the frequency determined by the determination circuit is fixed as a selected frequency (step 6).

After the operation for selecting the optimum frequency due to the drive frequency sweeping, a power supply input switching signal. DS is outputted to the power supply input switching circuit 21 (FIG. 6) from the sequence selection control unit 25 (FIG. 7) in the frequency automatic adjustment control circuit 22.

Due to this switching signal DS, the power supply is switched from the DC power supply (battery) of voltage V1 (for example, 12 V) to the DC power supply (battery) of a voltage V2 (for example, 6 V) lower than the voltage V1. In response to this switching, the drive voltage Vout appearing on the output side of the step-up transformer 20 is also dropped to Vout2 from. Vout1 upon the start-up of lighting, and therefore, the device is in a normal lighting state (steps 7 and 8).

The light-emitting tube 1 which is an emission unit of the light source device 4 has an external electrode type configuration as previously mentioned. Therefore, the light-emitting tube 1 has a property such that, after starting a discharge with a voltage exceeding the discharge start voltage Vf, it can sustain the discharge with a voltage Vs lower than the discharge start voltage due to the action of the wall charges accumulated on the inner wall surface of the tube.

On the other hand, to obtain high emission luminance by this light source device 4, it is considered that the drive voltage is increased and the drive frequency is increased. However, there is a problem in which an increase in the drive voltage leads to decreasing the life of the device. Also, increasing the frequency leads to shortening the cycle of the sine wave. Therefore, it becomes difficult to implement the lighting operation for growing the discharge throughout the entire length of the pair of long electrodes of each discharge tube by utilizing the increasing process of the sine wave, which is the feature of this light source device.

Accordingly, by the drive method according to the present embodiment, the light source device is driven to reliably perform the lighting operation at a high voltage upon the start-up of lighting, and is driven by lowering the peak value of the drive voltage by nearly half during the subsequent normal lighting. A DC power supply of an output voltage V1 is used as a power supply upon the start-up of lighting. That DC voltage V1 is converted and boosted to sine wave voltage with a peak value of 2000 V as the drive voltage Vout enough to start the discharge of the light source device 4.

On the other hand, during normal lighting, the DC power supply is switched to the power supply of an output voltage V2 so that the peak value of the boosted sine wave output voltage becomes about 1000 V. Such voltage switching is more beneficial than adjusting the voltage at the output side of the step-up transformer 20. According to the drive method in the present embodiment, even if the drive frequency is set higher, uniform and strong discharge emission expanding along the pair of long electrodes throughout the entire length of the light-emitting tube 1 in the longitudinal direction can be obtained by lowering the peak value of the drive voltage during normal lighting.

Notably, in burst driving for intermittently applying a drive voltage as shown in FIG. 11, if normal driving is performed at a voltage higher than the discharge start voltage Vf as in the initial discharge, it may lead to unstable discharge at the time of applying a voltage again. That is, too much wall charges are accumulated at the discharge gap, resulting in that a self-erase discharge is caused in which a discharge is generated due to a potential difference of wall charges themselves when the voltage application is stopped. On the other hand, in the present invention, different from conventional light source driving, the device is driven by lowering a voltage during normal driving to a level capable of sustaining the discharge, whereby stable driving is enabled. In addition, wall charges accumulated on the wall of the tube are adequately retained for several hours even after the drive voltage is stopped, whereby the discharge can instantaneously be restarted by applying the sustain voltage again.

Although the drive voltage Vs during the normal lighting operation is a voltage capable of sustaining the discharge by using wall charges, it is determined according to the length of the electrode in order to grow the discharge to either side of the electrodes 14X and 14Y along the tube axial direction. Therefore, if the length of the electrode is long, the peak value of the sustain voltage Vs is not necessarily set to be equal to or lower than the discharge start voltage Vf between the adjacent ends of the pair of electrodes (at the discharge gap G). The length of the effective light emission region that can be covered by a single pair of electrodes is determined according to the relation between the breakdown voltage of the discharge gap and the peak value of the drive voltage. To expand the effective light emission region with the drive voltage being suppressed, the device can be configured such that multiple pairs of electrodes are arranged along the longitudinal direction of the light-emitting tube.

Second Embodiment

[Drive Circuit]

Figure 12:
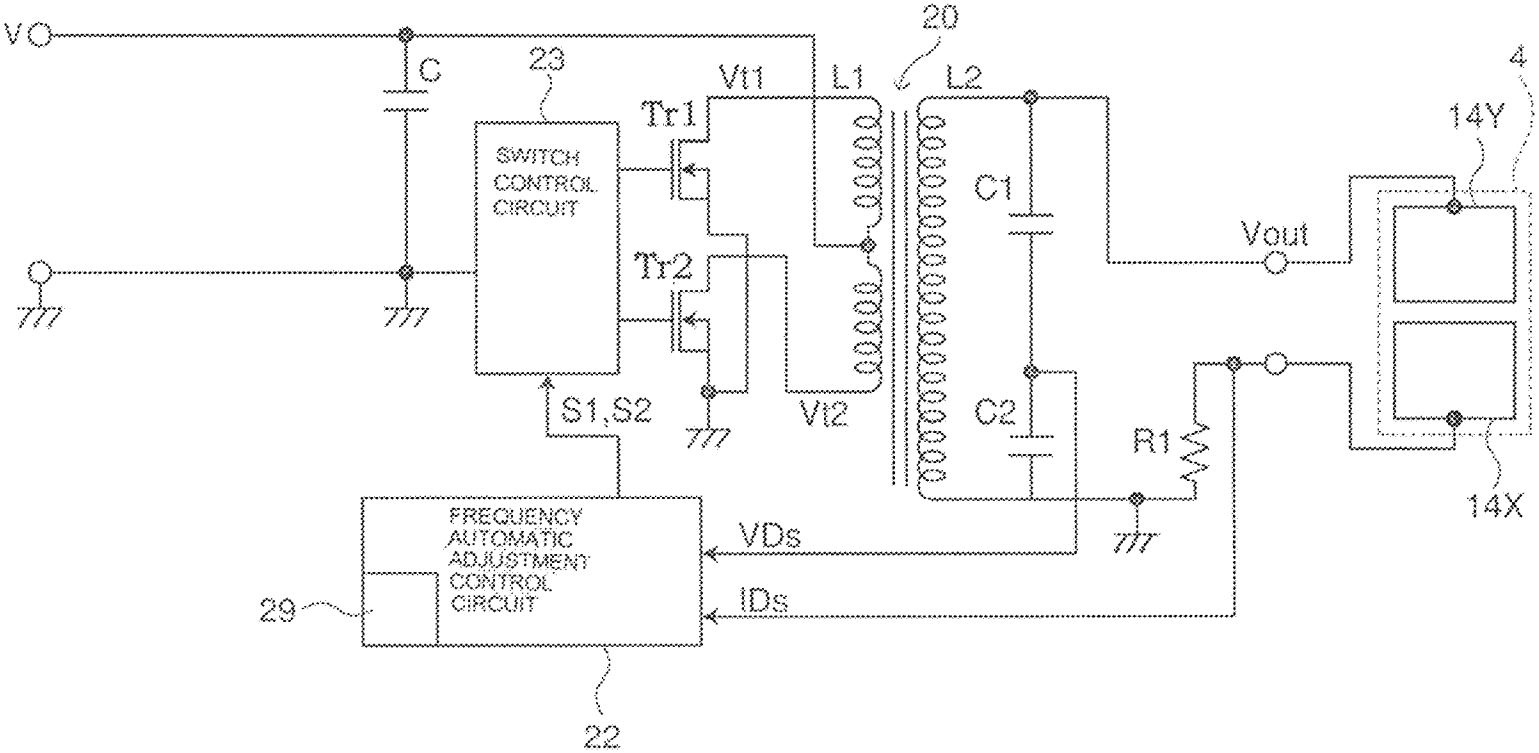
FIG. 12 is a block diagram showing a drive circuit according to a second embodiment of the present invention.

FIG. 12 is a diagram, corresponding to FIG. 6, showing a drive circuit in the light source device 4 or the flat light source device 40 according to a second embodiment of the present invention. This embodiment is characterized in that lowering of the drive voltage after the initial lighting operation is made by controlling an amount of primary current for the step-up transformer 20, in place of the DC power supply switching method in the first embodiment.

Specifically, as compared to the first embodiment shown in FIG. 6, the drive circuit in FIG. 12 is not provided with the power supply input switching circuit 21, and instead, additionally provided with an amplitude switching control unit 29 in the frequency automatic adjustment control circuit 22. The other configuration is the same as that in the first embodiment.

The amplitude switching control unit 29 issues a duty ratio control signal for controlling the duty ratio of the frequency control signals S1 and S2 to the frequency control signal generation unit 24, after the initial lighting operation period set in advance by the sequence selection control unit 25 (FIG. 7) is ended.

Figure 13:
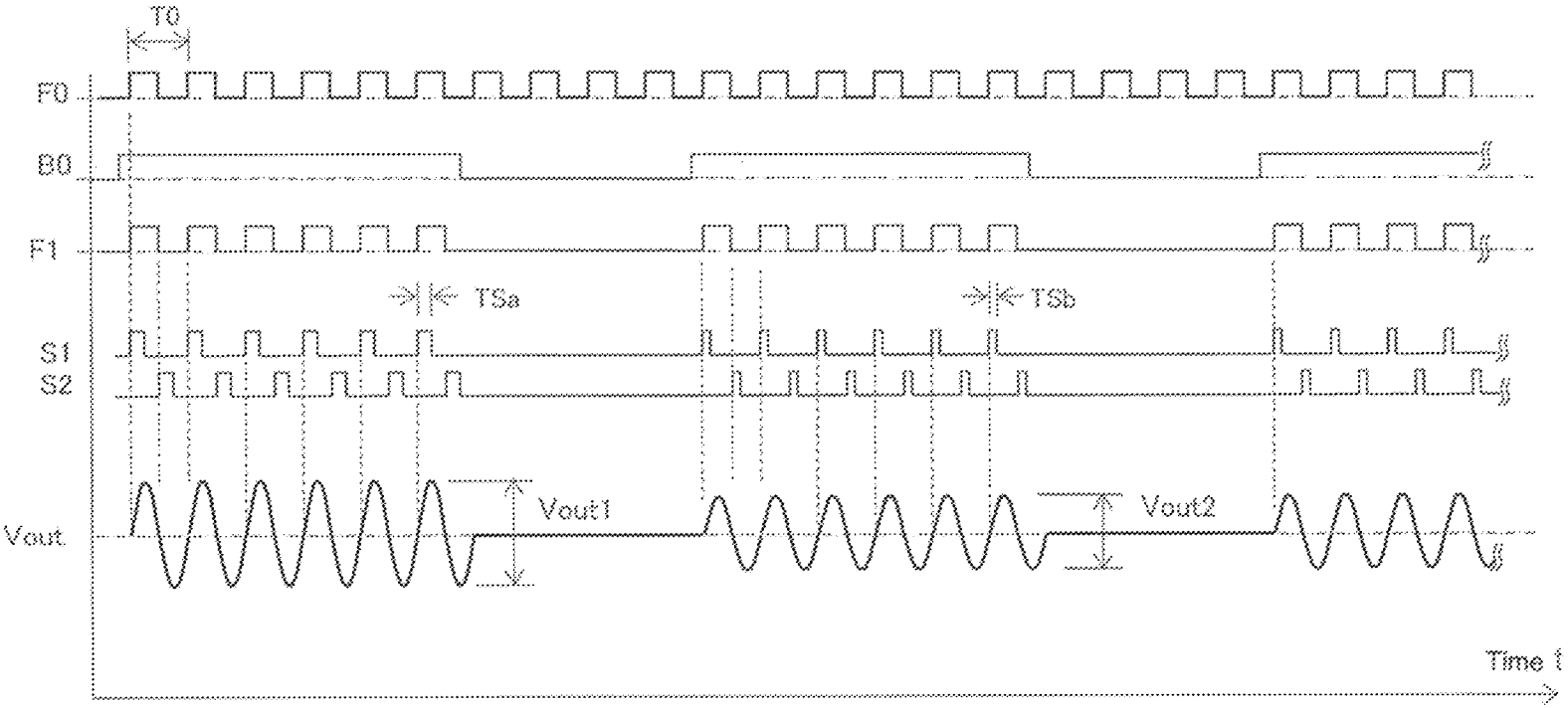
FIG. 13 is a time chart for describing a drive method according to the second embodiment.

As shown in the respective waveform time charts in the second embodiment in FIG. 13, the pules widths of the frequency control signals S1 and S2 are narrowed to TSb from TSa, and the duty ratio is changed to TSb/T0 from TSa/T0, in response to the duty ratio control signal.

Therefore, the conduction time of the switching transistors TR1 and TR2 which are on-off controlled by the frequency control signals S1 and S2 in an on state is shortened, and the current flowing through the primary winding L1 of the step-up transformer 20 is decreased according to the pulse width. Thus, the amplitude value of the sine wave voltage obtained at the output side of the step-up transformer 20 is lowered to Vout2 from Vout1.

Third Embodiment

[Initial Lighting Start Sequence]

The above-mentioned embodiments have described the operation for switching the drive voltage between at the time of starting initial lighting and during normal lighting. However, when a voltage Vo exceeding the discharge start voltage Vf is applied just after the switch is turned on for starting the initial lighting operation, an excessive overshoot voltage may be generated to damage the drive circuit. Specifically, the gas discharge device to be driven is a capacitive load, and a load capacitance after a discharge is started becomes significantly smaller than a large capacitance before driving is started. Therefore, if a large alternating voltage is suddenly applied to a load of a small capacitance from the step-up transformer which is an inductance component, an excessive overshoot voltage having a secondary response waveform according to the drive frequency is likely to be generated, and this voltage may exceed the breakdown voltage of the components.

Figure 14:
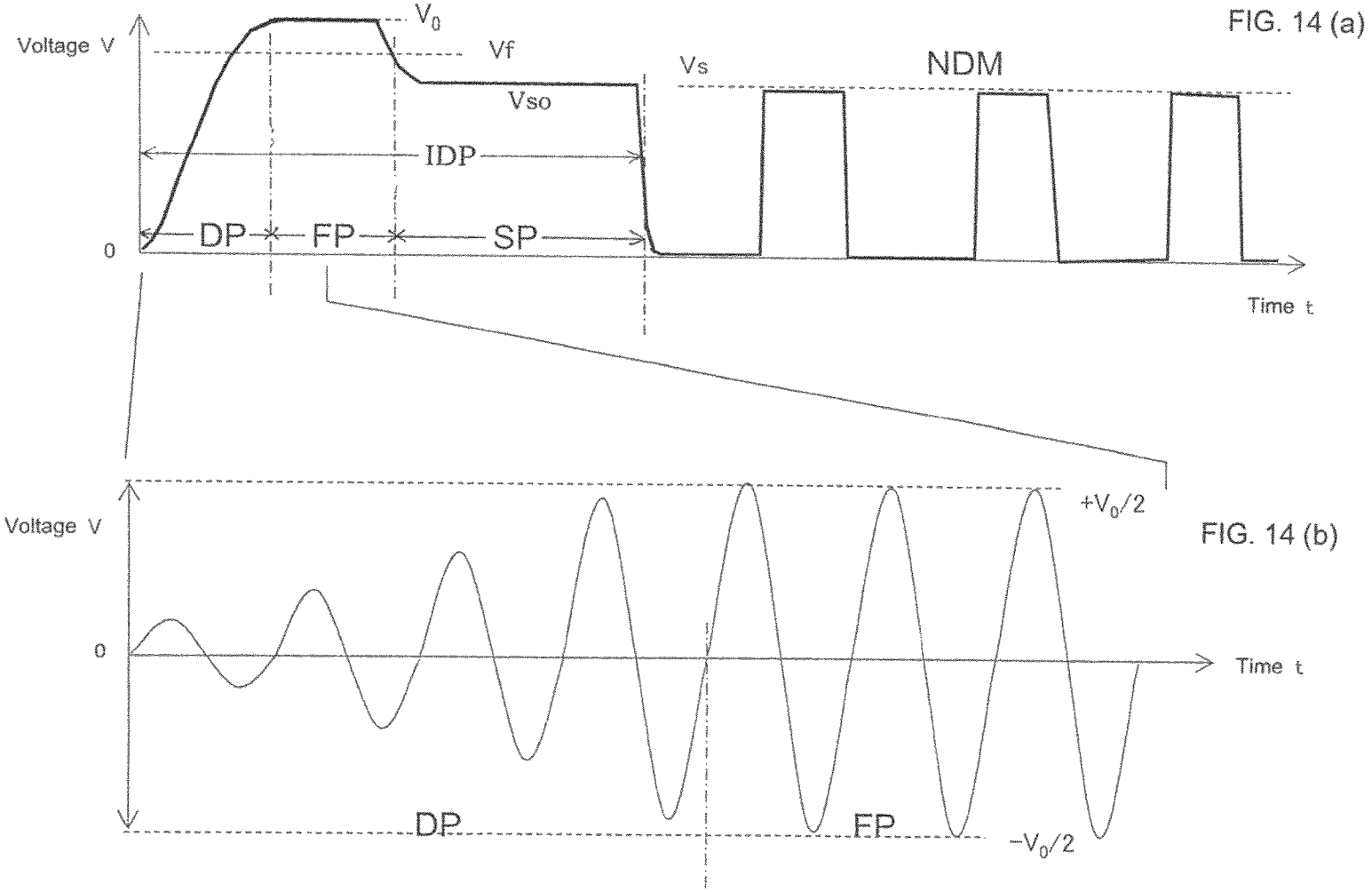
FIG. 14 is a time chart for describing a drive sequence upon an initial lighting start-up according to a third embodiment of the present invention.

FIG. 14(*a*) is a waveform envelope showing an initial driving sequence for stably starting the device by eliminating the above-mentioned problem during the operation for starting initial lighting. An initial lighting start period IDP has sequences of three stages, which are a buffering period DP, a writing period FP, and a stabilization period SP. During the buffering period DP, the sine wave voltage applied from the output transformer of a power supply is gently increased to be raised to Vo exceeding the discharge start voltage Vf in the discharge gap G. Thereafter, the writing period FP with several cycles are executed at this voltage level Vo, by which an initial discharge is started between the pair of electrodes 14X and 14Y. The change in the sine wave voltage waveform during this period is shown in FIG. 14(*b*).

After the writing period FP, the stabilization period SP for applying a sine wave of a stabilization voltage Vso lower than the discharge start voltage Vf is set to stabilize the initial discharge accompanied by the generation of wall charges. After the initial lighting drive sequence in three stages is executed, an operation of a normal discharge mode NDM is performed. In the normal discharge mode, a sine wave of a sustain voltage VS lower than the voltage Vo at the time of initial lighting is intermittently applied in a predetermined burst cycle to make an operation for sustaining the discharge using wall charges. During the discharge sustaining period in the normal lighting operation, the light emission intensity can be adjusted by adjusting the burst cycle of the intermittently applied drive voltage or the duty ratio of the application time. This will be described in detail later.

Figure 15:
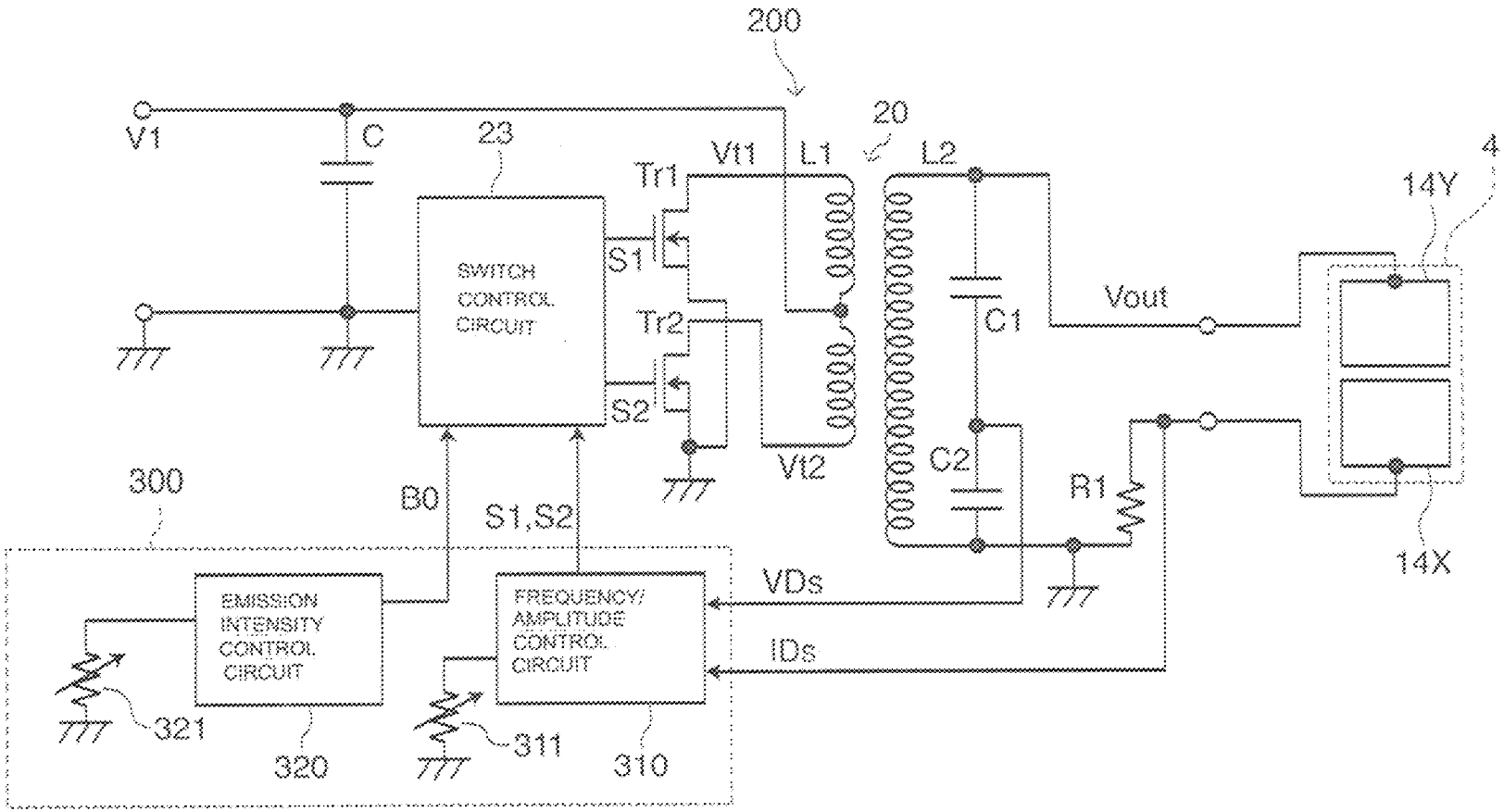
FIG. 15 is a diagram showing a structural example of a drive circuit for executing a drive method according to the third embodiment.
Figure 16:
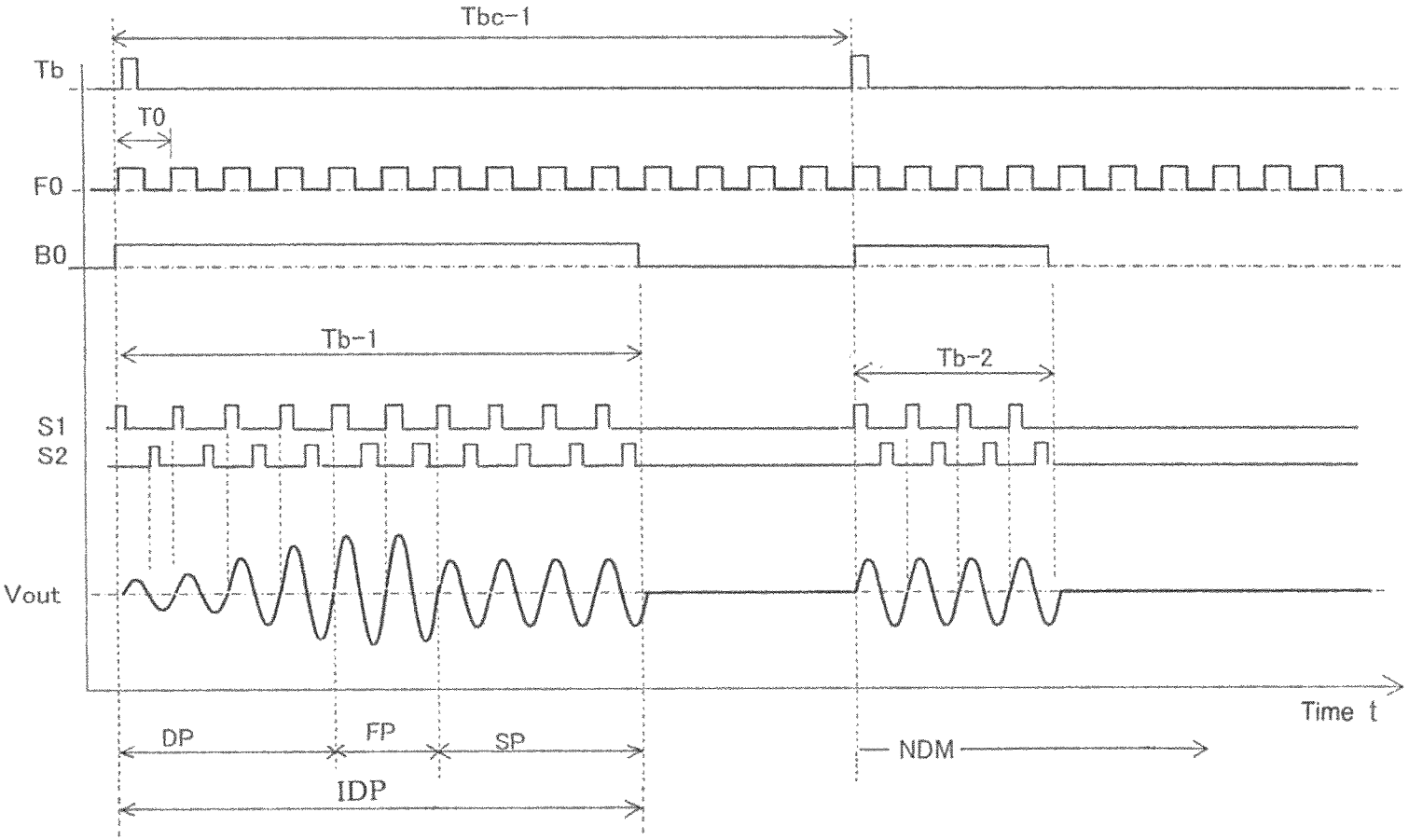
FIG. 16 is a time chart specifically showing an operating sequence upon an initial lighting start-up.

FIG. 15 is a configuration example of a drive circuit, for a light source device, performing driving according to a third embodiment including the above-mentioned initial lighting sequence. FIG. 16 shows operating waveform time charts for describing the operation of this drive circuit. The circuit roughly includes two parts of an alternating drive voltage generation unit 200 and an alternating drive voltage control unit 300 enclosed by a dashed line. The alternating drive voltage generation unit 200 has a configuration of an inverter power supply which is substantially the same as the circuit configuration shown in FIG. 12.

The alternating-current drive voltage control unit 300 includes a frequency/amplitude control circuit 310 and a light emission intensity control circuit 320. The frequency/amplitude control circuit 310 includes a circuit for generating a main clock signal F0 shown in FIG. 16 and a control circuit that counts the number of clocks corresponding to an initial burst cycle Tbc-1 from the main clock signal in the sequence set in advance to determine the burst length Tb-1, and generates switch control signals S1 and S2 with a predetermined duty ratio during that period. The frequency/amplitude control circuit 310 is also provided with a frequency adjusting trimmer 311 capable of externally adjusting a drive frequency.

Thus, during the initial burst period Tbc-1 at the time of starting initial discharge in the light source device 4 or the flat light source device 40, the duty ratio, that is, the pulse width, of the switch control signals S1 and S2 generated at the rising timing and the falling timing of the main clock signal F0 is changed as shown in FIG. 16 by the control of a sequencer. As a result, by the operation principle similar to the switching to the drive voltage Vout2 from the drive voltage Vout1 previously described with reference to FIGS. 11 and 12, the sine wave amplitude value of the drive voltage outputted from the step-up transformer 20 can be changed in three stages which are the buffering period DP, the writing period FP, and the stabilization period SP, as indicated by Vout in FIG. 16.

The initial burst cycle Tbc-1 is set to be equal to or five times as long as the burst cycle during normal driving of 100 to 1000 Hz, and the burst length Tb-1 for executing the three-stage initial driving sequence is set to have a duty ratio of 50% or more. That is, the initial burst cycle Tbc-1 is about 50 ms, and the burst length Tb-1 is 25 ms or longer.

Figure 17:
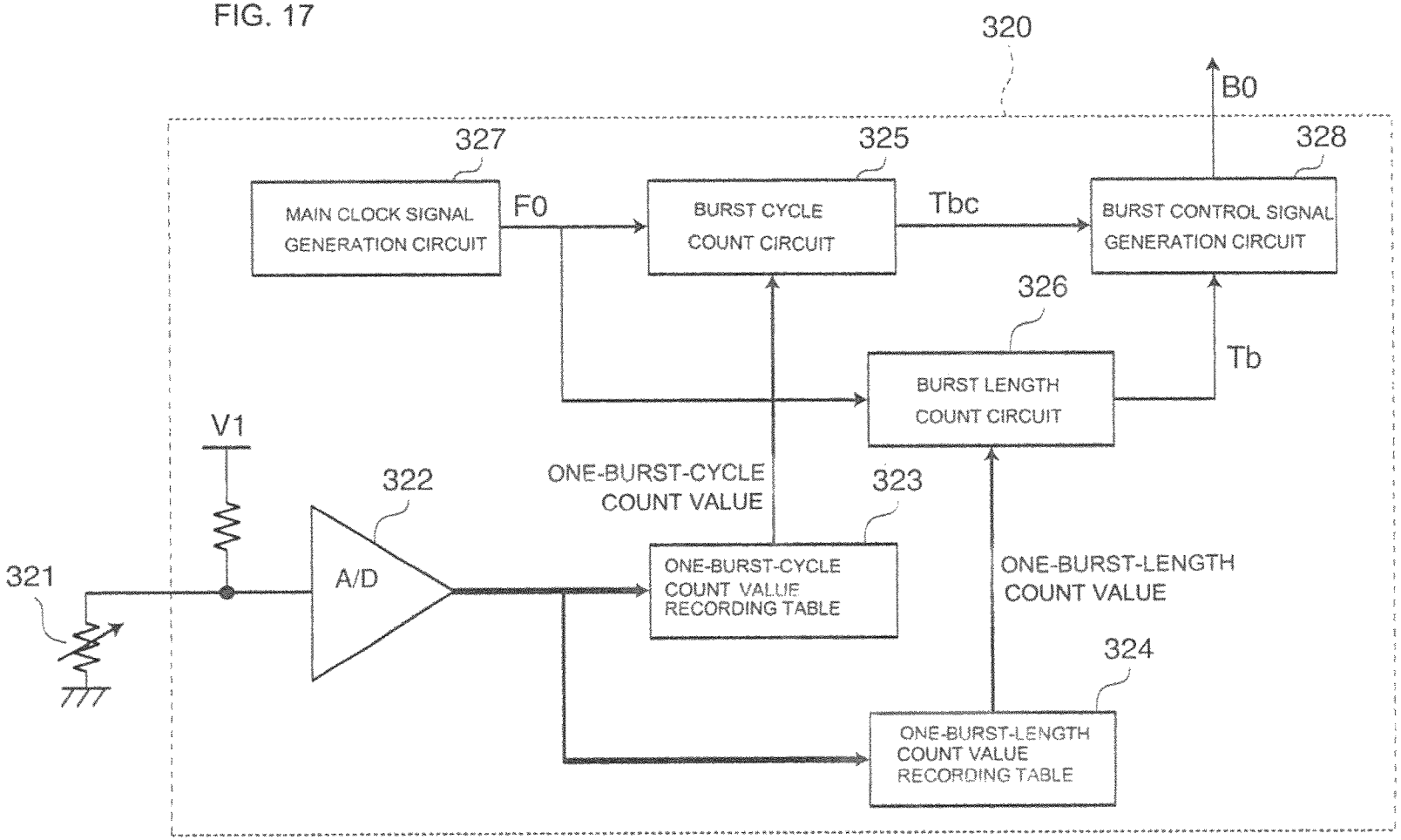
FIG. 17 is a block diagram showing a structural example of a light emission intensity control circuit in an alternating-current drive voltage control unit.

On the other hand, the light emission intensity control circuit 320 has the configuration shown in FIG. 17, for example. It controls the burst control signal B0 for determining the application cycle or the application time of the drive voltage during normal lighting to adjust the light emission intensity.

Figure 18:
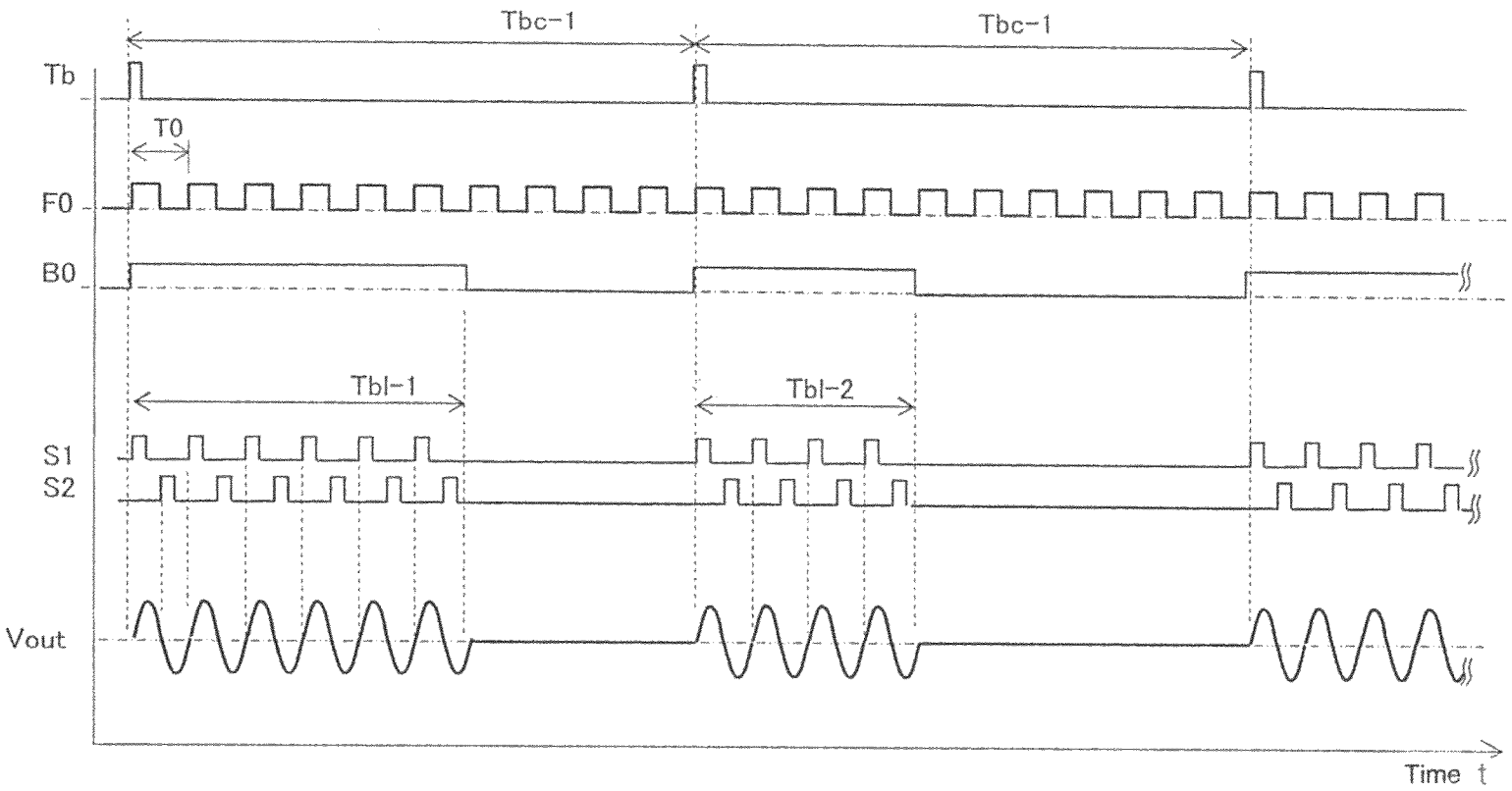
FIG. 18 is a time chart showing a first operating example for adjusting light emission intensity.
Figure 19:
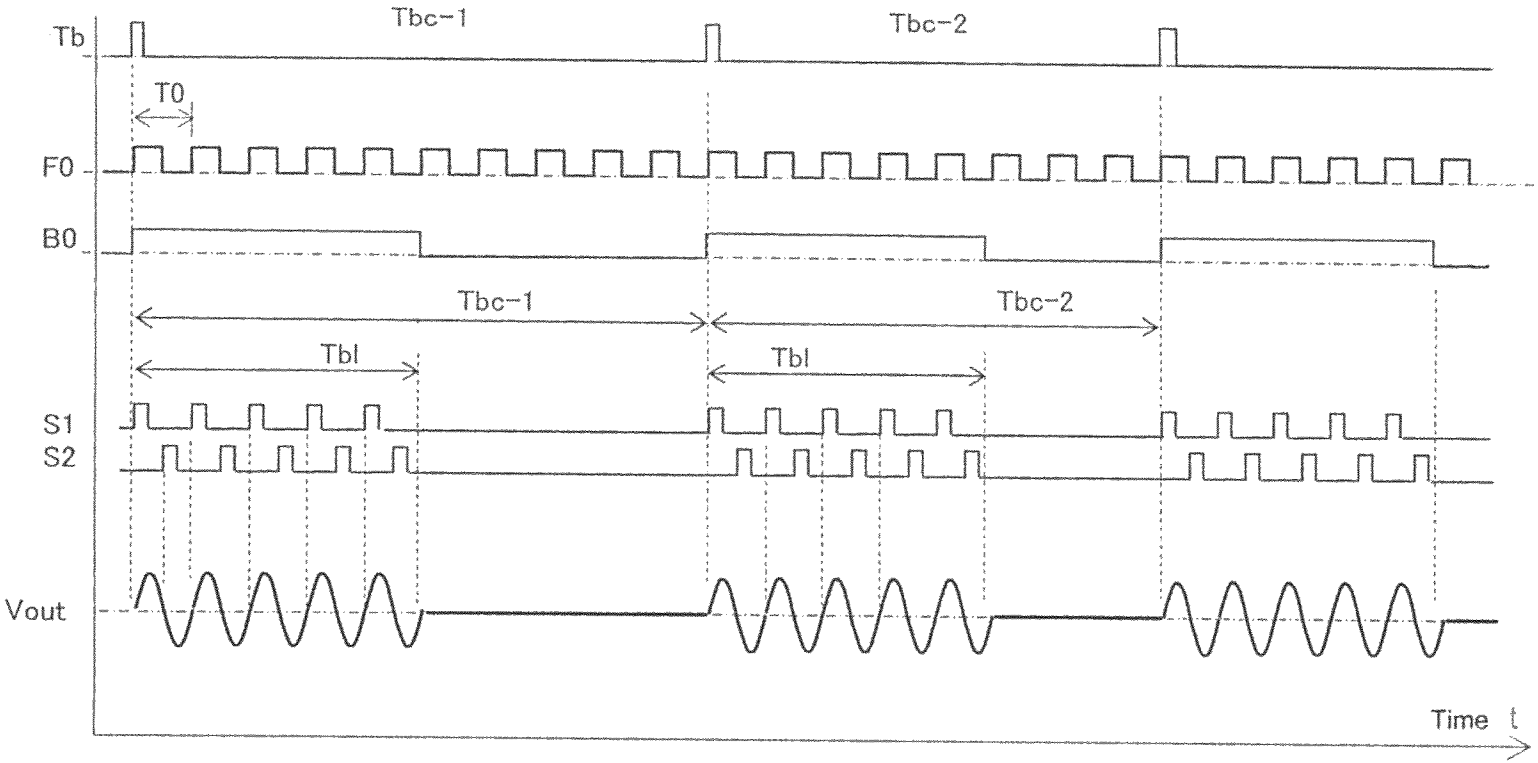
FIG. 19 is a time chart showing a second operating example for adjusting light emission intensity.

The number of discharge emission times per a unit time can be increased or decreased by changing the burst time length. Tb, that is, the duty ratio, with the application cycle of the drive voltage, that is, the burst cycle Tbc, being fixed. According to this operation, the light emission intensity is changed. Further, when the burst cycle Tbc is changed with the duty ratio being fixed, the number of discharge emission times per a unit time is also changed to be capable of adjusting the light emission intensity. FIG. 18 is a time chart for describing the operation when the light emission intensity is adjusted by changing the duty ratio with the burst cycle Tbe being fixed. FIG. 19 is a time chart for describing the operation when the burst cycle Tbe is changed with the duty ratio being fixed.

In relation to the configuration of the light emission intensity control circuit shown in FIG. 17, an analog intensity signal from a light emission intensity adjustment unit 321 is converted into a digital intensity signal by an A/D conversion circuit 322, and supplied to a one-burst-cycle count value recording table 323 and a one-burst-length value recording table 324. Thus, a count value according to a predetermined burst cycle and a burst length count value corresponding to the intensity signal are read, and respectively set to a burst cycle count circuit 325 and a burst length count circuit 326.

In this way, every time the number of clock signals F0 from a main clock signal generation circuit 327 corresponding to the count value set in the burst cycle count circuit 325 are counted, a burst cycle signal Tbc is supplied to a burst control signal generation circuit 328. Similarly, the number of main clock signals F0 corresponding to the burst length set in the burst length count circuit 326 are also counted, and every time the clock signal F0 is counted, the burst length signal Tb is supplied to the burst control signal generation circuit 328. The burst control signal B0 is generated by the burst cycle signal. Tbc and the burst length signal Tb, and applied to the switch control circuit 23 in the drive voltage generation unit as a light emission intensity control signal.

Note that the one-burst-cycle count value recording table 323 and the one-burst-length count value recording table 324 have recorded thereon count values for setting the initial burst cycle time and the three-stage drive voltage varying time for executing the sequence of the previously described operation at the time of starting initial discharge. When the power supply is turned on, the initial burst cycle Tbc-1 and the initial burst length Tb-1 described with reference to FIG. 16 are determined by the control signal from the sequencer, not shown, included in the frequency/amplitude control circuit 310.

Figure 20:
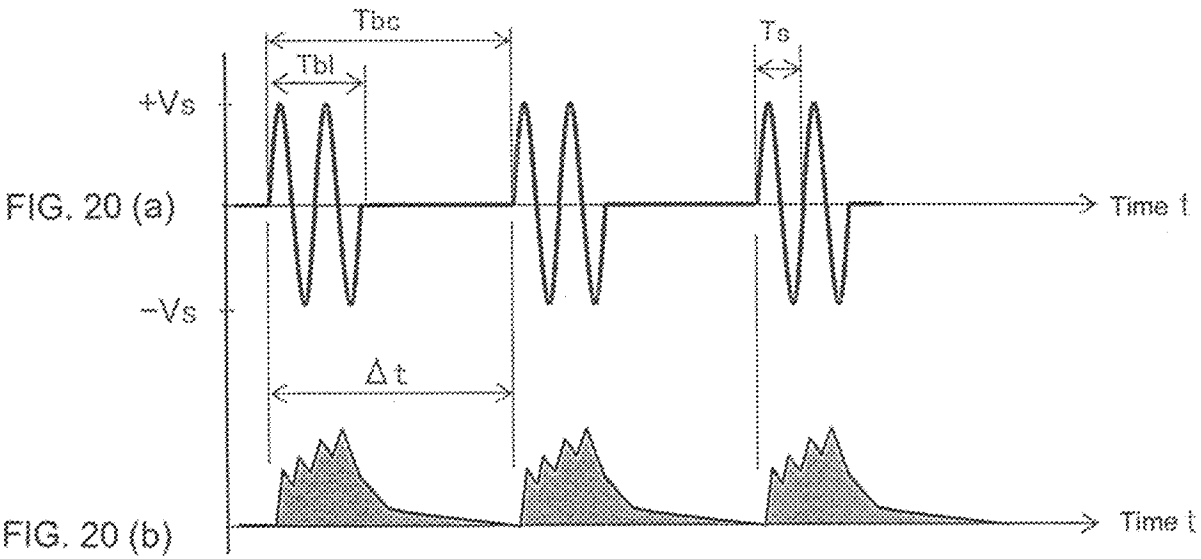
FIG. 20 is a time chart showing a relationship between a drive waveform and a light emission waveform of the light source device.

FIG. 20 shows the relationship between a drive voltage waveform (a) and a light emission waveform (b) when the burst driving described above is carried out in the present invention. A sine wave having a cycle of 25 μs (drive frequency of 40 KHz), for example, optimized by the method in the second embodiment is applied, as shown in FIG. 20(*a*), to the light source device having the light-emitting tube array configuration with the duty ratio according to predetermined light emission intensity. Thus, pulse emission shown in FIG. 20(*b*) according to the cycle of the applied sine wave is performed, and the light emission intensity according to the integrated value is obtained. The ratio (Tb/Tbc) of the burst length Tb to the burst cycle Tbc for applying the drive voltage, that is, the duty ratio, corresponds to the light emission intensity in substantially a linear relation. The driving with the duty ratio of 100% means that the drive voltage is continuously applied, and due to this driving, the maximum light emission intensity can be obtained.

However, the continuous lighting or the driving with a high duty described above may shorten the life of the light source device, and thus, not preferable. On the other hand, if the duty ratio is low and the burst length is too short, discharge and light emission may be unstable. It is preferable that the burst length Tb is set such that the drive sine wave has at least five or more cycles in one burst cycle Tbc. The burst frequency can be set within the range of 100 to 1000 Hz, and the duty ratio can be set within the range of 10 to 90%, as appropriate. The light emission intensity is increased and decreased by adjusting the burst cycle or the duty ratio within such a range. If the frequency of the drive sine wave is 40 KHz, and the burst frequency is 1000 Hz, the number of waves of the sine wave in one burst length is 20 cycles with the duty ratio of 50%, and forty discharges and light emission associated therewith are generated.

Other Modifications

While the present invention has been described in detail with reference to the first, second, and third embodiments, the optimum condition of the drive voltage is not necessarily limited to the resonance point of the drive circuit. That is, although the driving with the resonance frequency is a guideline for the optimum condition, the resonance frequency is determined not only by the capacitance of the light source device 4 but also by a comprehensive circuit constant including the output inductance of the step-up transformer 20 in the inverter power supply, and when the output inductance of the secondary coil is low to decrease the resonance frequency, it is not necessarily appropriate to drive the device with the low frequency. In addition, when the emission area of the light source device 4 is increased, the capacitance that becomes a load is accordingly varied and the resonance frequency is thus varied. However, it is not necessarily appropriate to vary the drive frequency by following such a variation. In addition, the drive voltage does not necessarily have a sine waveform in a strict sense, and it naturally has an alternating waveform having distortion due to the load capacitance and inductance.

The gist of the present invention lies in that, to reliably and stably drive a light source device composed of a gas discharge device having an external electrode configuration for a long term, an initial driving period at a high voltage is set at the time of starting initial discharge, and after that, normal discharge driving at a low sustain voltage is performed. The method in which a voltage exceeding Vf is applied during normal discharge driving as in the initial discharge driving causes self-erase of wall charges every off-period of the burst driving, which may cause another discharge to be unstable. On the other hand, the method for performing the normal discharge driving at a sustain voltage level using wall charges enables stable duty adjustment.

In addition, in the present invention, the operation sequence during the initial discharge start period is optimized to execute a reliable lighting operation. Further, once the initial discharge is generated, stable discharge can intermittently be maintained by using wall charges, whereby the emission luminance or the light emission intensity can be adjusted by adjusting the burst cycle or the duty ratio in the burst driving method, or the reduction in the light emission intensity caused by aged deterioration of the light source device can be compensated. Even if the burst driving of a predetermined cycle is performed for a certain period of time, and then, the driving is temporarily stopped, the normal lighting operation can be instantaneously restarted without executing the initial driving sequence, if the stop time is within several ten hours.

A method for compensating the degradation in light emission intensity is as follows. For example, the duty ratio is set to be about 75% in initial setting, and driving is started at 75% of the maximum light emission intensity. After the emission intensity is dropped to about 80% of the initial luminance after a long-term driving, the duty ratio is set to be 100% by using the light emission intensity adjustment unit to improve the luminance by about 25%. Thus, the luminance can be recovered to almost the initial luminance. In this method, the light emission intensity is recovered by changing the duty ratio once. However, the duty ratio can be changed more than once at short intervals. In this way, the actual use time can be prolonged, that is, the life of the device can be prolonged, by adjusting the duty ratio.

Examples of the method for adjusting the duty ratio include a method in which a signal is externally supplied to the control unit in the circuit and a method in which a physical unit such as a DIP switch is built in a circuit in advance and this switch is switched at the time of maintenance. In addition, in order to automate the operation for keeping the light emission intensity constant, the emission intensity on a light-emitting surface may be detected, and this detection signal may be digitized and added to a feedback control element for changing the count value of the recording tables 323 and 324 in the light emission intensity control circuit 320.

Alternatively, upon shipment, a voltage detection signal value and a current detection signal value may be obtained from an emission luminance level or the like when the device is driven at a predetermined drive frequency, these values may be set to each determination circuit as reference levels, and feedback control to restore the change in the detection signal from the set level may be performed to select and search a drive frequency.

In any case, according to the present invention, a light source device using a gas discharge, particularly a mercury-free ultraviolet light source device having a large area, can be stably driven over a long term, and thus, the present invention is significantly beneficial for broadening an ultraviolet application field.

EXPLANATION OF NUMERALS

1 ultraviolet light-emitting gas discharge tube (light-emitting tube)
2 glass tube
3 ultraviolet phosphor layer
4 light source device
10 light-emitting tube array structure
11 insulating film
12 adhesive agent
13 insulating substrate
14 a pair of electrodes
14X X electrode
14Y Y electrode
15 electrode structure
16C heat dissipation substrate
17 drive power source
20 step-up transformer
21 power supply input switching circuit
22 frequency automatic adjustment control circuit
23 switch control circuit
24 frequency control signal generation unit
25 sequence selection control unit
26 voltage determination circuit
27 current determination circuit
28 power determination circuit
29 amplitude switching control unit
G electrode slit
L1 primary winding
L2 secondary winding

What is claimed is:

1. A drive method for a light source device which uses a gas discharge and which is configured to include a glass envelope filled with a discharge gas and having a front side and a back side, and a pair of electrodes facing an outer surface of the back side of the glass envelope and extending to either side with a gap constituting a discharge gap formed therebetween, the drive method comprising the steps of:

applying a first alternating drive voltage between the pair of electrodes upon an initial discharge start-up to generate an initial discharge, the first alternating drive voltage exceeding a discharge start voltage at the discharge gap, and then applying a second alternating drive voltage lower than the first alternating drive voltage, between the pair of electrodes to perform a normal discharge operation.

2. The drive method for a light source device according to claim 1, wherein an inverter power supply having a function of switching a drive voltage and applying an alternating drive voltage obtained by converting a DC voltage to between the pair of electrodes from a secondary winding of a step-up transformer is used as a drive source for the light source device, and after an initial discharge start-up of the light source device, the drive voltage is switched to a second drive voltage lower than the first drive voltage applied upon the initial discharge start-up to perform a normal discharge operation.

3. The drive method for a light source device according to claim 2, wherein the drive voltage is switched by switching a voltage of a DC power supply applied to a primary winding of the step-up transformer.

4. The drive method for a light source device according to claim 2, wherein a switching transistor for converting the DC voltage into an AC voltage is connected to a primary winding of the step-up transformer, and the drive voltage is switched by varying a duty ratio of a control signal for driving the switching transistor.

5. The drive method for a light source device according to claim 2, wherein the inverter power supply is provided with a frequency automatic adjustment control circuit, wherein a drive frequency is swept during an initial discharge start-up period of the light source device, and a drive voltage and a drive current during sweeping are detected and fed back to the automatic frequency adjustment control circuit to search an optimum drive frequency.

6. The drive method for a light source device according to claim 5, wherein the sweeping operation of the drive frequency is performed within a frequency range determined in advance around a resonance frequency determined by the light source device and a secondary winding of the step-up transformer connected to the light source device.

7. The drive method for a light source device according to claim 5, wherein the drive voltage and the drive current are respectively detected as a relative value with respect to a predetermined reference value, and a frequency on a point at which a maximum value of a change in the drive frequency within a sweeping range is selected as an optimum drive frequency.

8. The drive method for a light source device according to claim 1, wherein the normal discharge operation is performed by intermittently applying the second alternating-current drive voltage.

9. The drive method for a light source device according to claim 4,

Wherein light emission intensity is adjusted by varying at least one of a duty ratio and a repeating cycle of an application time and a non-application time of an alternating drive voltage during the normal discharge operation.

10. The drive method for a light source device according to claim 1, wherein driving upon the initial discharge start-up is performed in an operating sequence including a buffering period, a writing period, and a stabilization period, wherein an amplitude of an alternating drive voltage to be applied between the pair of electrodes is gradually increased during the buffering period, a first alternating drive voltage with an amplitude exceeding a discharge start voltage is applied between the pair of electrodes during the writing period, and an alternating drive voltage lower than the drive voltage during the writing period is applied during the stabilization period.

11. The drive method for a light source device according to claim 1, wherein a second alternating drive voltage to be applied during a normal discharge operation after the initial discharge start-up period is set to a voltage for sustaining a discharge generated during the initial discharge start-up period by using wall charges generated by the discharge.

12. A drive method for a light source device which uses a gas discharge and which is constructed by arraying, parallel to one another, a plurality of external electrode type discharge tubes each having a thin glass tube filled with a discharge gas and a pair of electrodes facing an outer surface of the thin glass tube and extending to either side along a longitudinal direction with a discharge gap being formed therebetween, wherein, after a power supply is turned on for an initial discharge start-up, a first sine wave drive voltage is applied to cause a discharge in the discharge tubes to form wall charges on an inner wall surface of the discharge tubes, and then, a second sine wave voltage lower than the first sine wave drive voltage is applied to sustain the discharge by using the wall charges, and the second sine wave drive voltage is intermittently applied to enable adjustment of light emission intensity.

13. A drive circuit for driving a light source device which uses a gas discharge and which is configured to include a glass envelope filled with a discharge gas and having a front side and a back side, and a pair of electrodes facing an outer surface of the back side of the glass envelope and extending to either side with a gap constituting a discharge gap formed therebetween, the drive circuit comprising:

a power supply unit that generates an alternating drive voltage to be applied between the pair of electrodes;

a voltage control unit that changes a voltage value of the alternating drive voltage between upon an initial discharge start-up and during a subsequent normal discharge; and a control unit controlling such that the alternating drive voltage is intermittently applied and being capable of adjusting at least one of a duty ratio and a repeating cycle of an application time and a non-application time.

14. The drive circuit for a light source device according to claim 13, wherein the light source device has a gas discharge tube array configuration comprising a plurality of thin glass tubes filled with a discharge gas and a pair of electrodes facing an outer surface of the thin glass tubes and extending along a longitudinal direction with a discharge gap being formed therebetween, the power supply unit has an inverter power supply configuration for applying a sine wave drive voltage between the pair of electrodes, and the voltage control unit varies a duty ratio of a control signal to a switching transistor that alternately switches a direction of a current supplied to a primary winding of a step-up transformer included in the inverter power supply to thereby change a voltage value of an alternating drive voltage to be applied between the pair of electrodes from a secondary winding of the step-up transformer.

15. An ultraviolet irradiation device comprising:

an ultraviolet light source device which uses a gas discharge and is configured such that a plurality of discharge tubes, each of which has inside an ultraviolet phosphor layer and is filled with a discharge gas, is arranged parallel to one another along an ultraviolet irradiation surface, and a pair of common electrodes is arranged to face the back side of the ultraviolet irradiation surface and to extend along the longitudinal direction of the discharge tubes with a discharge gap being formed therebetween; and an inverter power supply that applies an alternating drive voltage between the pair of common electrodes, wherein the inverter power supply is provided with a voltage control unit that switches a voltage value of the alternating drive voltage and a control unit that intermittently applies an alternating drive voltage in a predetermined cycle and duty ratio.

* * * * *